US007877967B2

(12) United States Patent
Monzel

(10) Patent No.: US 7,877,967 B2
(45) Date of Patent: Feb. 1, 2011

(54) METHOD AND DEVICE FOR THE MANUFACTURE OF DISPOSABLE, ONE-WAY, SINGLE-USE BEVERAGE KEGS FOR USE IN HOME BARS

(75) Inventor: Alois Monzel, Moerstadt (DE)

(73) Assignee: KHS AG, Dortmund (DE)

( * ) Notice: Subject to any disclaimer, the term of this patent is extended or adjusted under 35 U.S.C. 154(b) by 0 days.

(21) Appl. No.: 12/209,407

(22) Filed: Sep. 12, 2008

(65) Prior Publication Data

US 2009/0223175 A1 Sep. 10, 2009

Related U.S. Application Data

(63) Continuation-in-part of application No. PCT/EP2007/004600, filed on May 24, 2007.

(30) Foreign Application Priority Data

Jun. 2, 2006 (DE) ..... 10 2006 026 279

(51) Int. Cl.
*B65B 7/28* (2006.01)

(52) U.S. Cl. ..... 53/471; 53/467; 53/485; 53/90; 53/133.2; 53/284.5

(58) Field of Classification Search ..... 53/467, 53/470, 471, 473, 484, 485, 490, 90, 133.1, 53/133.2, 137.1, 266.1, 267–268, 284.5
See application file for complete search history.

(56) References Cited

U.S. PATENT DOCUMENTS

| | | | | |
|---|---|---|---|---|
| 4,319,612 | A * | 3/1982 | Golding | 141/1 |
| 4,665,940 | A * | 5/1987 | Jacobson | 137/212 |
| 5,649,575 | A * | 7/1997 | Till | 141/90 |
| 5,720,148 | A | 2/1998 | Bedin et al. | |

FOREIGN PATENT DOCUMENTS

| | | |
|---|---|---|
| DE | 26 21 993 | 12/1977 |
| DE | 34 34 023 | 3/1986 |
| DE | 101 38 365 | 2/2003 |
| DE | 102 45 318 | 4/2004 |
| GB | 1904 06970 | 9/1904 |
| WO | WO 98/47770 | 10/1998 |

OTHER PUBLICATIONS

International Preliminary Report on Patentability PCT/EP2007/004600 and English translation thereof.
International Search Report PCT/EP2005/004600 and English translation thereof.

* cited by examiner

*Primary Examiner*—Christopher Harmon
(74) *Attorney, Agent, or Firm*—Nils H. Ljungman & Associates

(57) ABSTRACT

A method and device for the manufacture of packaging units or disposable single-use kegs in which a disposable fitting is retained on a blow-molded body by an inwardly-projecting flange structure which engages with an outwardly-projecting flange structure on the blow-molded body.

20 Claims, 16 Drawing Sheets

METHOD AND DEVICE FOR THE MANUFACTURE OF DISPOSABLE, ONE-WAY, SINGLE-USE BEVERAGE KEGS FOR USE IN HOME BARS

This application is a Continuation-In-Part application of International Patent Application No. PCT/EP2007/004600, filed on May 24, 2007, which claims priority from Federal Republic of Germany Patent Application No. 10 2006 026 279.4, filed on Jun. 2, 2006. International Patent Application No. PCT/EP2007/004600 was pending as of the filing date of this application. The United States was an elected state in International Patent Application No. PCT/EP2007/004600.

BACKGROUND

1. Technical Field

The present application relates to a method for the formation of packaging units, each consisting of a container closed with a keg fitting and filled with a liquid to be bottled, and to a device for the formation of packaging units.

2. Background Information

Background information is for informational purposes only and does not necessarily admit that subsequently mentioned information and publications are prior art.

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

The object of the present application is to indicate a method by which the manufacture of such containers, and especially including non-reusable containers, can be simplified, generally with regard to the complexity of the mechanical equipment and design effort desired.

SUMMARY

To accomplish this object, the present application teaches the method for the formation of packaging units, each comprising a container closed with a keg fitting and filled with a liquid to be bottled, and a device for the formation of packaging units.

The method according to the present application is often performed in a plant in which the containers are manufactured from a plastic material, generally from PET (hence their alternate designation as PET kegs), by means of blow molding from plastic preforms immediately or substantially prior to their use. For the method according to the present application, there are a number of different variants that are possible with regard to the sequence of the individual process steps, including among others:

Variant 1

In at least one possible embodiment of the present application, the blow-molding of the containers, placement of the fittings on the containers, feeding of the containers prepared with the fittings to a filling machine, connection of the fittings and the containers in the filling machine and subsequent filing of the container via the fittings with the liquid to be bottled.

Variant 2

In yet another possible embodiment of the present application, the blow-molding of the containers, placement of the fittings on the containers and connection of the fittings with the containers in a separate station or machine upstream of the filling machine, followed by a feed of the containers assembled with the fittings to the filling machine 20 and the filling of the containers via the fittings with the liquid to be bottled.

Variant 3

In still another possible embodiment of the present application, the blow-molding of the containers, preparation of the fittings in the filling machine 20, feed of the fittings to the containers in the filling machine 20, connection of the fittings with the containers in the filling machine 20 and filling of the container with the liquid to be bottled via the fittings.

The fittings are generally realized or may be realized in the form of basket or flat non-reusable fittings, and comprise a plastic fitting body which is designed to be connected to the respective container by screwing, pressing or locking, and with a fitting valve insert that can be made of stainless steel, for example.

Regardless of the individual configuration of the method of the present application and of the chronological sequence of the individual process steps, the containers are, in at least one possible embodiment according to the present application, filled with the liquid to be bottled via the fitting after the final connection of the fittings with the containers.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Possible embodiments of the present application are explained in greater detail below with reference to the exemplary embodiments that are illustrated in the accompanying figures, in which.

DESCRIPTION OF EMBODIMENT OR EMBODIMENTS

Figure 1:
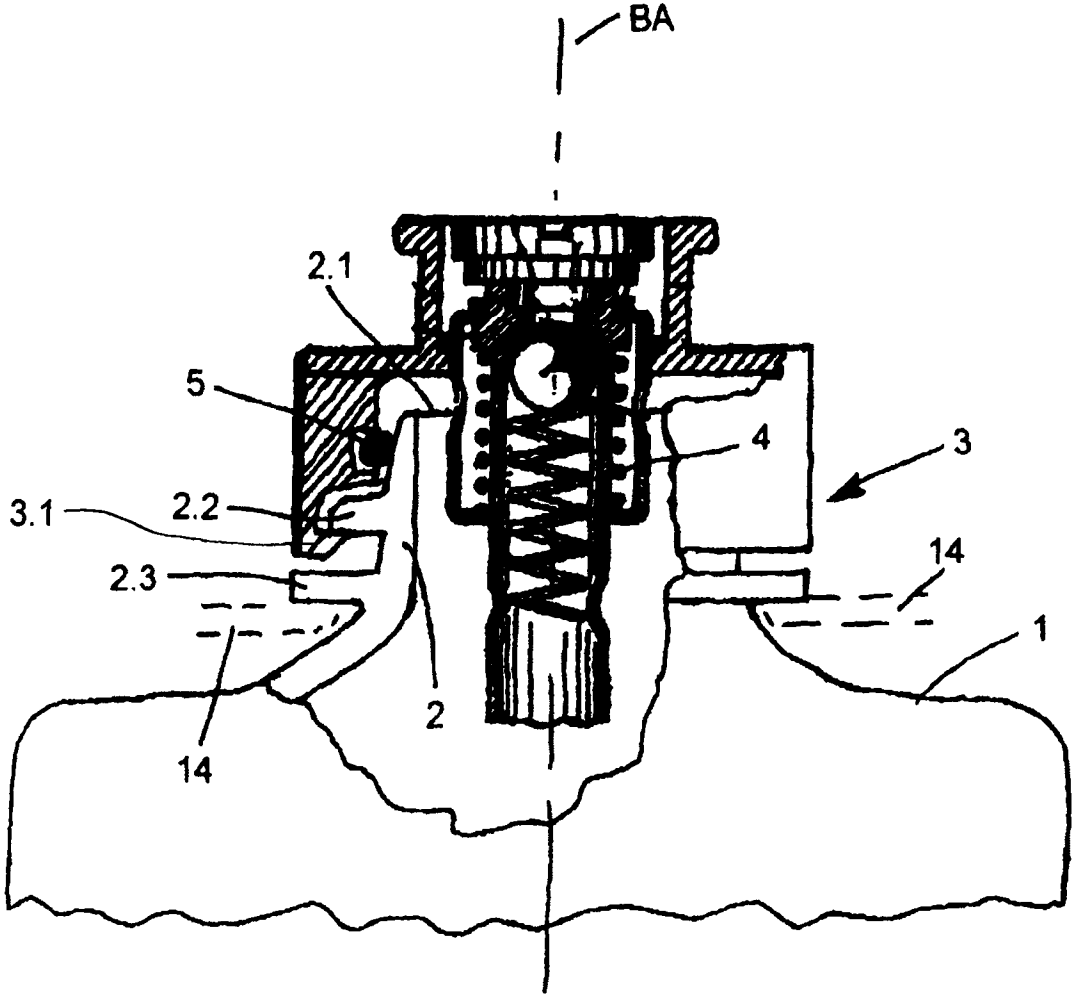
FIG. 1 is a partial illustration of a container (PET keg) in the vicinity of the mouth of the keg, together with a non-reusable fitting provided on the mouth of the keg, shown in partial section.

FIG. 1 shows a large-volume container which is manufactured by blow molding from a plastic material, e.g. polyethylene terephthalate (PET), and in one possible embodiment, for example, in the form of a non-reusable container with a volume of 10 to 20 liters. The container 1 filled with a liquid to be bottled, e.g. mineral water, table water, beer or a similar beverage, is tightly closed by a non-reusable fitting 3 in the vicinity of its top container mouth 2.1 which, as shown in FIG. 1, is formed in the shape of a container neck 2. In the illustrated possible embodiment, the fitting 3 is generally made or may be made of plastic with a fitting valve insert 4 made of stainless steel and is essentially permanently sealed to a flange 2.2 formed on the container neck with the use of a gasket 5 and a fitting lip 3.1 by pressing or locking.

Figure 2:
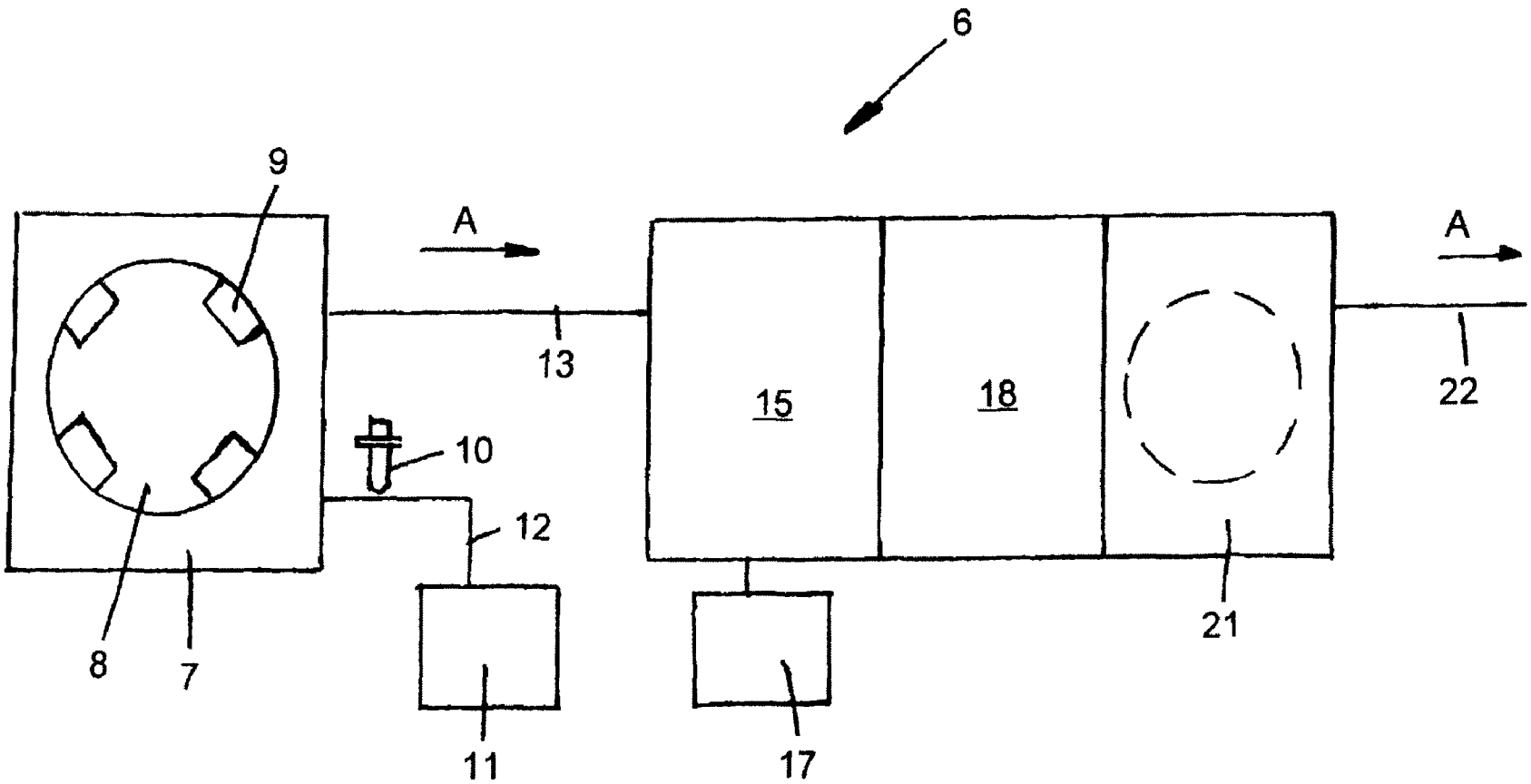
FIG. 2 is a schematic block diagram of a plant for the molding and subsequent filling of the PET keg.

FIG. 2 is a block diagram or function diagram which shows in a very simplified form a plant 6 for the manufacture of the containers 1, for the installation of an individual fitting 3 on each container 1 and for the subsequent filling of each container 1 with the liquid to be bottled via the fitting 3 and/or valve insert 4 on the container 1.

In FIG. 2, 7 is a blowing machine which has, on a rotor 8 that can be driven in rotation around a vertical machine axis, a plurality of blow molds 9, on which the individual containers 1 are each formed by the injection stretch blow molding of preforms 10. The preforms 10 which are made of a thermoplastic plastic, namely PET, are fed to the blowing machine 7 and/or to the blow molds 9 located on it individually and are generally pre-heated, and possibly via a conveyor line or conveyor rail 11. The containers 1 manufactured by blow molding are transported from the blowing machine 7 on a transport element 13 on which the containers 1, each with a container axis BA, are oriented in the vertical direction and with the container mouth 2.1 on top, and are held suspended from a flange or neck ring 2.3 which is also formed on the container neck 2 and projecting radially outward beyond the container neck 2, as shown in FIG. 1 with the two-part container carrier 14. By means of suitable transport means, e.g. with the use of compressed air, the containers 1 are transported to a work station 15 (Arrow A). The preforms 10 are already preformed with the container neck 2, with the container mouth 2.1 and the two flanges 2.2 and 2.3. During the blow molding of the containers 1 from the preforms 10, the wall thickness or the material thickness of these container elements remains largely intact, so that each container 1 has an increased strength in the vicinity of its container neck 2 and the flanges 2.2 and 2.3 that are located there.

Figure 3:
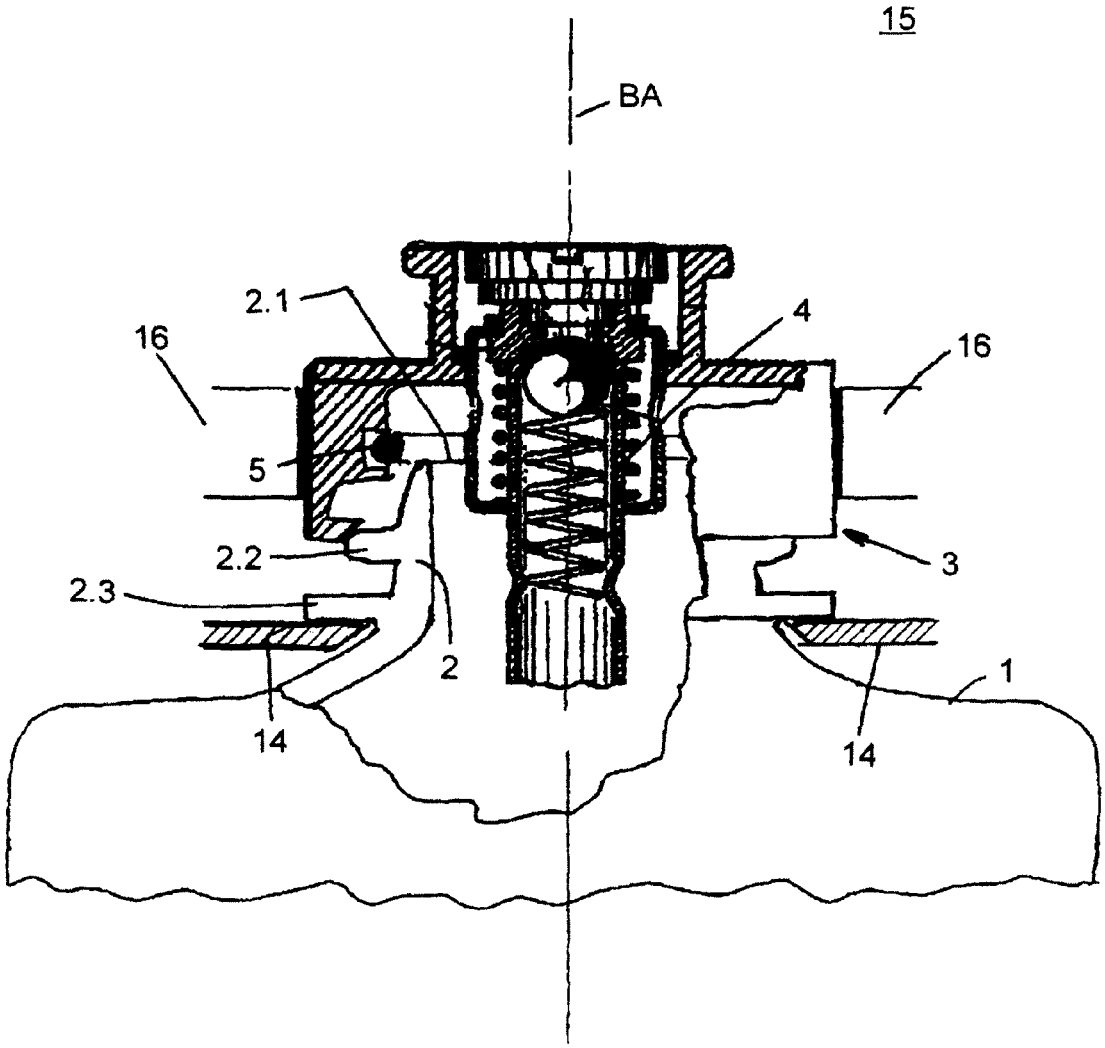
FIGS. 3 to 5 show a container in a view similar to FIG. 1, and specifically in various phases of handling.

In the work station 15, as illustrated in FIG. 3, a fitting 3 with a centering and transfer element 16 is inserted in the container mouth 2.1 of each container, which is suspended by its flange 2.3 on the container carrier 14. The fittings 3 are fed to the station 15 via a conveyor line from a supply unit 17.

Figure 4:
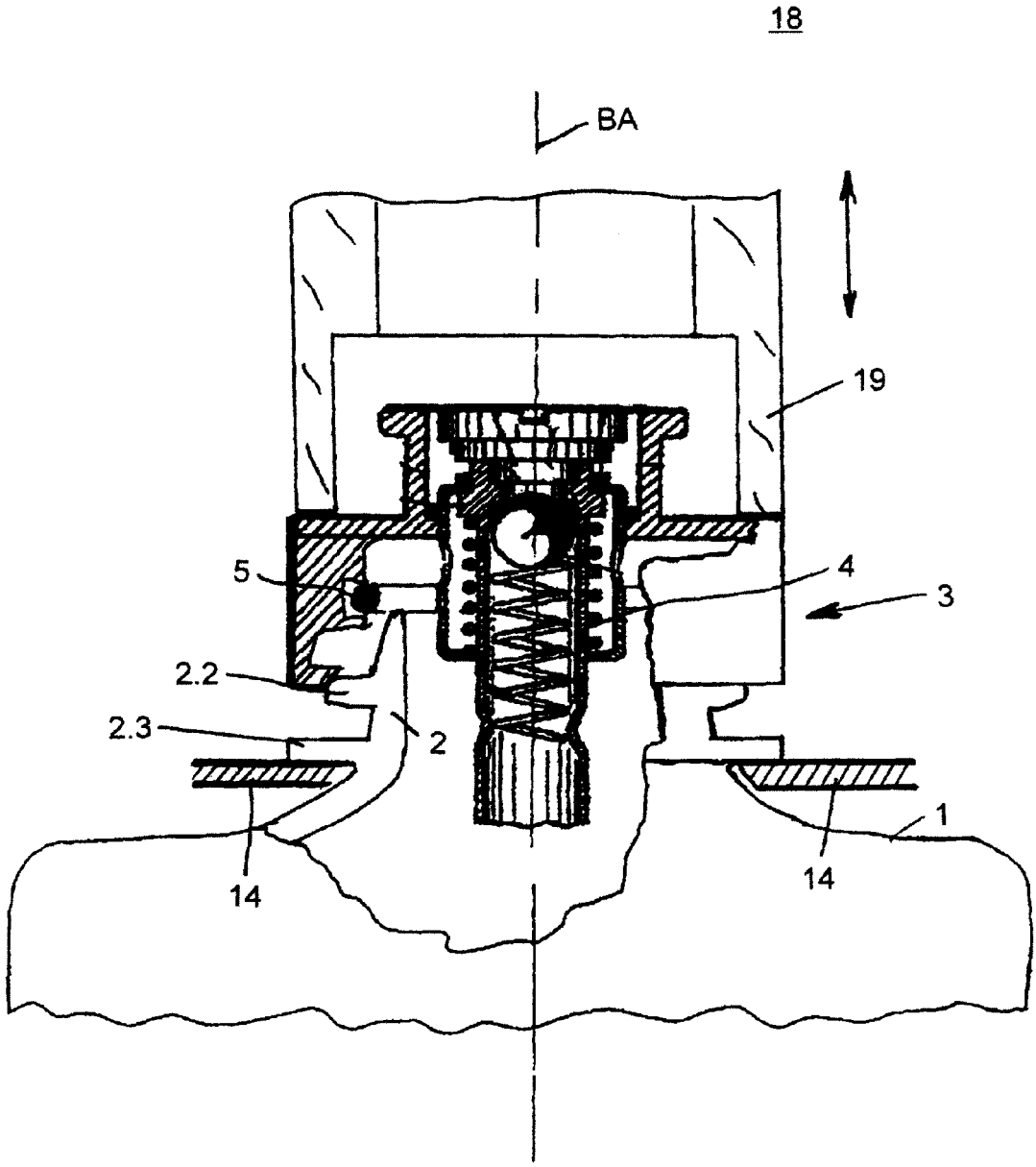

Each container 1 thus provided with a fitting 3 then continues to travel, hanging suspended by its flange 2.3 on the container carrier 14, into a station 18 which is realized in the form of a filling machine 20 and, as shown in FIG. 4, first seals the individual fitting 3 which is pre-assembled with the gasket 5 by pressing it to the container mouth 2.1. The pressing is accomplished by means of a ring-shaped closing and pressing tool 19 which can be moved, for example, in the direction of the container axis BA and with which, by lowering the respective fitting 3, the fitting is pressed into the container opening 2.1 until it finally grips the flange 2.2 on the container neck 2 in a form-fitting manner from behind, i.e. it is held to the container neck 2 by locking, and the gasket 5 seals the space between the container neck 2 and the fitting 3. The closing and pressing tool 19 is generally realized so that the pressing tool 19 can substantially simultaneously be used as a centering tool to fasten the respective fitting 3 by pressing it in place in a centered position with reference to the container axis BA to the container opening 2.1.

Figure 5:
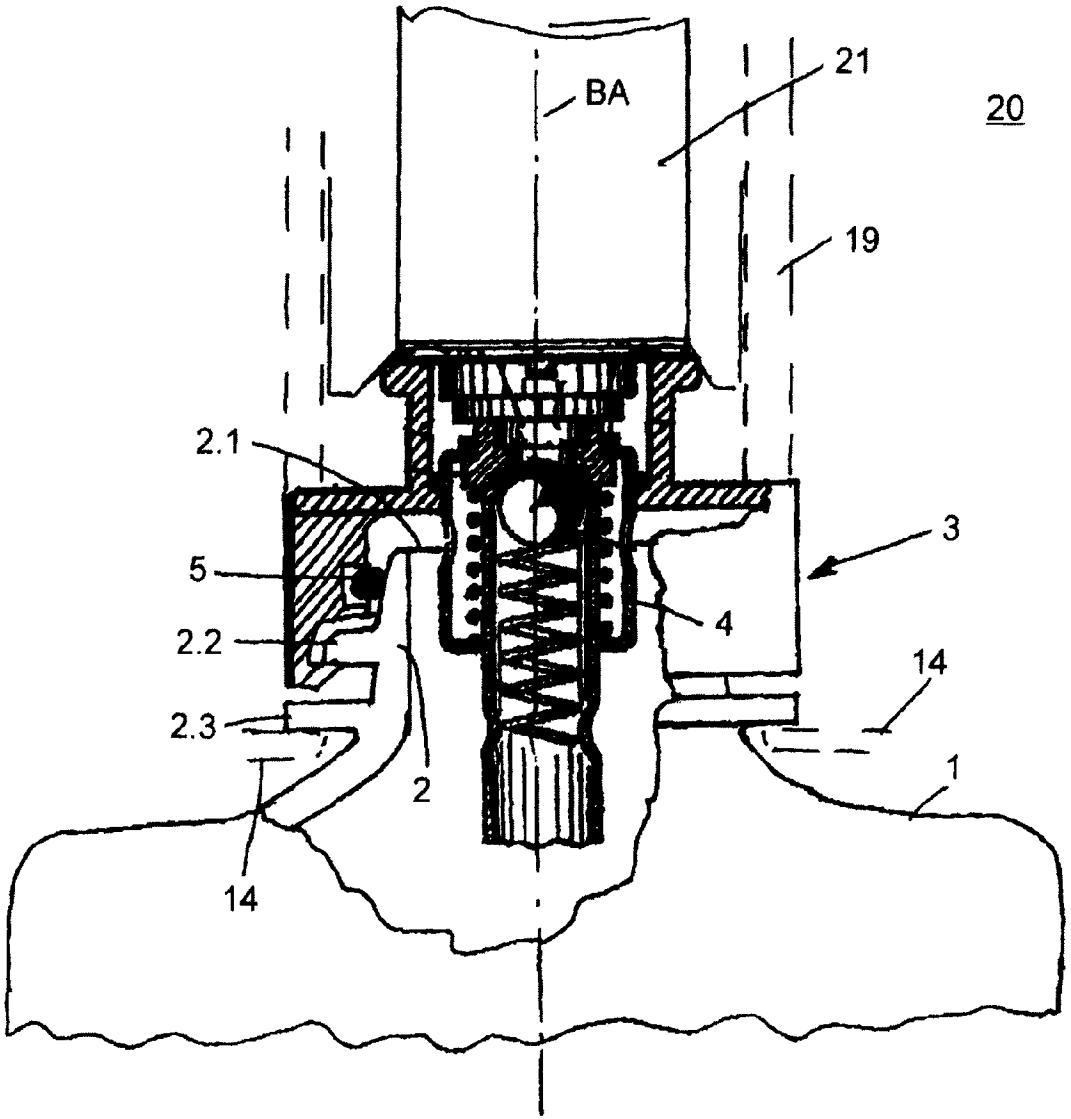

Each container 1 thus assembled with a fitting 3 then travels, suspended by its flange 2.3 on the container carrier 14, into a station 20 in which, as illustrated in FIG. 5, each container 1 is filled with the liquid to be bottled, and possibly in contact from above with a filling element 21 against which the containers 1 are held in tight contact with their fitting 3 during the filling. The station 20 therefore forms the filling machine 20. This machine can be realized, for example, in the form of a linear filling machine 20 or in the form of a filling machine 20 that employs a rotary construction, and possibly with a plurality of bottling positions, each of which has a filling element 21 and the container carrier 14, on the periphery of a rotor that is driven in circulation around a vertical machine axis.

The filled containers 1 are then fed via a conveyor 22 in the direction of transport A to an additional application and/or processing step, e.g. a labeling machine.

In the description presented above, it is assumed that the insertion of the fitting 3 into the container openings 2.1, the pressing of the fittings 3 on the respective container opening 2.1 and the filling of the containers 1 take place in different stations 15, 18, and 20 respectively that are located sequentially in the direction of transport A. In one possible embodiment of the present application, the functions of at least the stations 18 and 20 are combined in a single station or device, namely in a filling machine 20 employing a linear or rotary construction, in which by means of a relative movement between the individual container 1 and the pressing tool 19, and possibly the movement of the filling element 21 in the vertical axis and/or in the container axis BA, the fitting 3 is fastened tightly to the container 1 and the sealing position between the container and its fitting 3 and the filling element 21 for the filling process is reached. In at least one possible embodiment according to the present application, the reciprocating movement which is necessary or essentially necessary for the pressing of the fittings 3 on the containers 1 and for the achievement of the sealed connection between a filling element 21 and a container 1 and/or its fitting 3 can be generated by a common reciprocating element, for example by a corresponding raising of the respective container holder 14 and of the container 1 held on the container carrier 14, first toward the pressing tool 19 and then toward the filling element 21.

In at least one possible embodiment of the present application, when the filling machine 20 is realized with a rotary construction, on the periphery of the rotor driven in circulation around a vertical machine axis there are a plurality of filling positions, each of which has a filling element 21, with a container carrier 14, with a pressing tool 19 and with means that make possible a controlled relative movement in the vertical direction between the pressing tool 19 and the container carrier 14 and between the filling element 21 and the container carrier 14 of each filling position. The containers each arrive individually at a container inlet to one of the filling positions. The filled containers are then transported forward individually to a container discharge on the conveyor 22. The pressing of the fitting 3 and the subsequent filling then take place in the angular portion of the rotary movement of the rotor between the container inlet and the container outlet.

It is also possible to integrate the function of the station 15 into the filling machine 20, for example on a filling machine 20 that employs a rotary construction, so that after the delivery of the individual container 1 to a filling position of the rotor, the fitting 3 is first placed on the container and then fastened to the container by pressing.

It is further possible to integrate the functions of the stations 15 and 18 into one machine or device so that the containers that are fully assembled with the fittings are fed to the filling machine 20 that forms the station 20, and are in turn suspended, held by their tops, in this filling machine 20 from the top by their flange 2.3 and filled with the liquid to be bottled.

What the possible embodiments described above essentially have in common is that the containers 1 are manufactured immediately or substantially immediately before their use, namely immediately or substantially immediately before they are filled with the liquid to be bottled, by blow molding, that the containers 1, after the manufacture, are continuously held suspended on their flange 2.3 throughout the entire process (insertion of the fitting 3 and filling of the container 1), i.e. no reorientation and/or repositioning of the container 1 is essentially necessary or desired, that the fittings 3 are connected with the containers 1 by placing the fittings on the container mouths 2.1 and then pressing them into place, and possibly on their container neck 2 or on containers supported on the flange 2.3 located on the container neck, i.e. with the containers supported on an area of the container that has greater strength on account of its greater wall thickness, and that in at least one embodiment of the present application, the containers are filled generally after the installation of the fittings 3.

Figure 6:
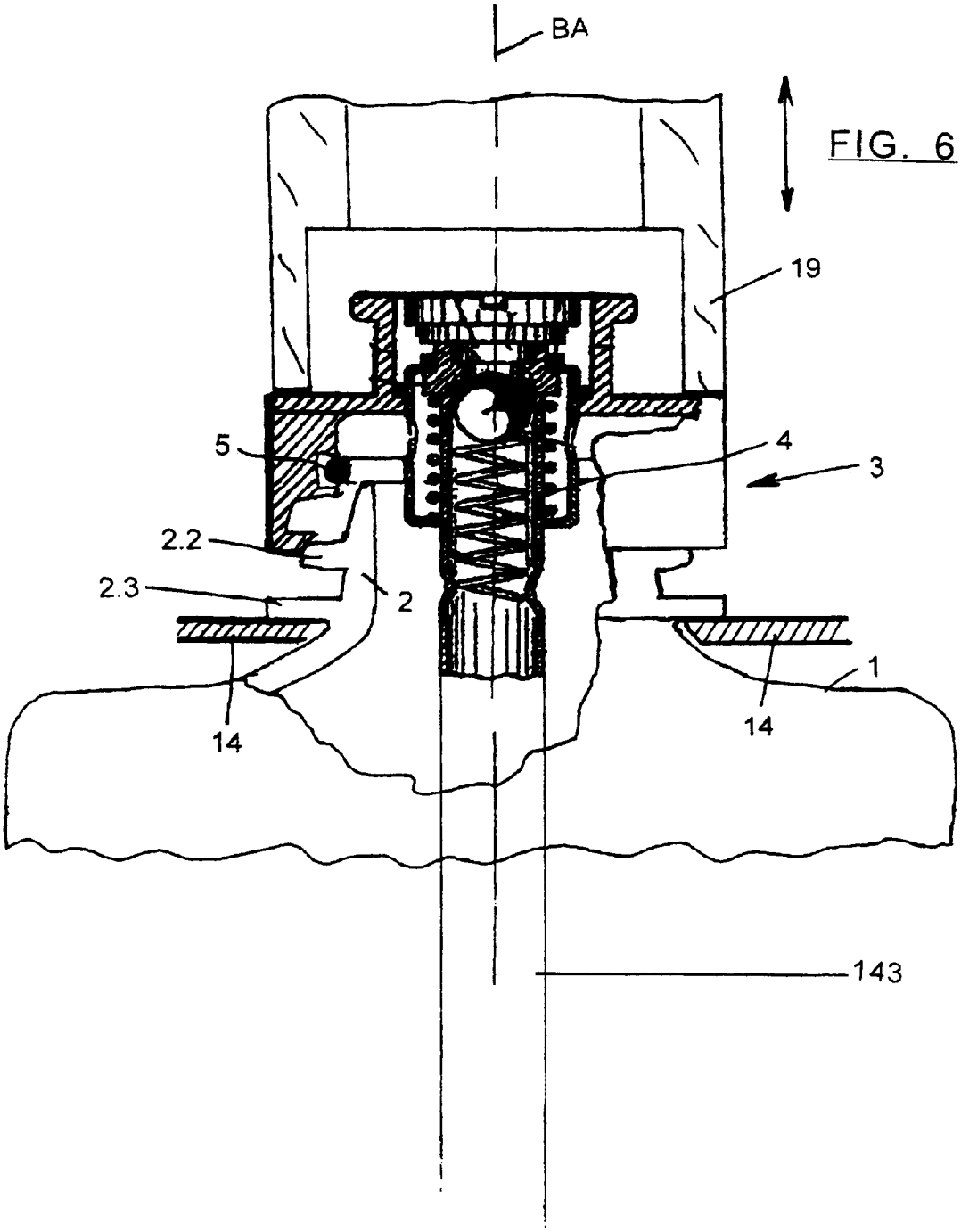
FIG. 6 shows a container in a view similar to FIG. 1, and including a dispensing tube or dispensing spear.

FIG. 6 shows a container 1, with a container neck 2, a container mouth 2.1, flanges 2.2 and 2.3, a fitting 3, a fitting valve insert 4, a gasket 5, two-part container carrier 14, and a container axis BA, as well as a pressing tool 19 and a dispensing tube or dispensing spear 143.

Figure 7:
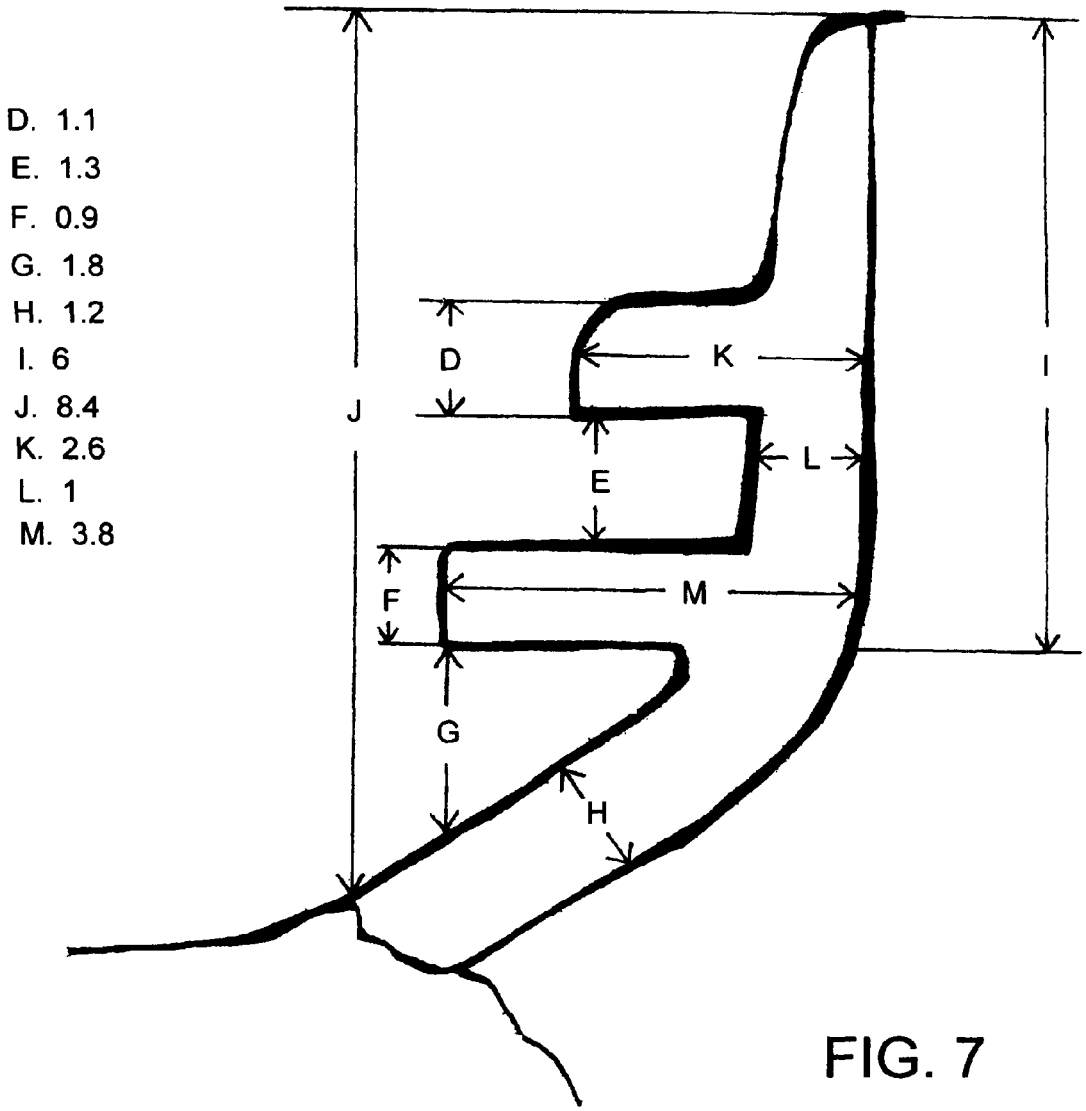
FIG. 7 shows the dimensions of a cutaway view of the keg opening, including flanges.

FIG. 7 shows a possible set of dimensions of a cutaway view of the keg opening and keg flanges of a container 1. The dimension D is the longitudinal thickness of a keg flange 2.2 or 2.4. The dimension E is the distance between two keg flanges 2.2 and 2.3 or two keg flanges 2.4 and 2.3. The dimension F is the longitudinal thickness of a keg flange 2.3. The dimension G is the distance between the lower keg flange 2.3 and the container 1. The dimension H is the thickness of the neck below the flanges. The dimension I is the longitudinal height between the lower keg flange 2.3 and the top of the container mouth 2.1. The dimension J is the longitudinal height between the top of the container 1 and the top of the container mouth 2.1. The dimension K is the length of the keg flange 2.2 or keg flange 2.4. The dimension L is the thickness of the neck between two keg flanges 2.2 and 2.3 or two keg flange 2.4 and 2.3. The dimension M is the length of the keg flange 2.3.

Figure 8:
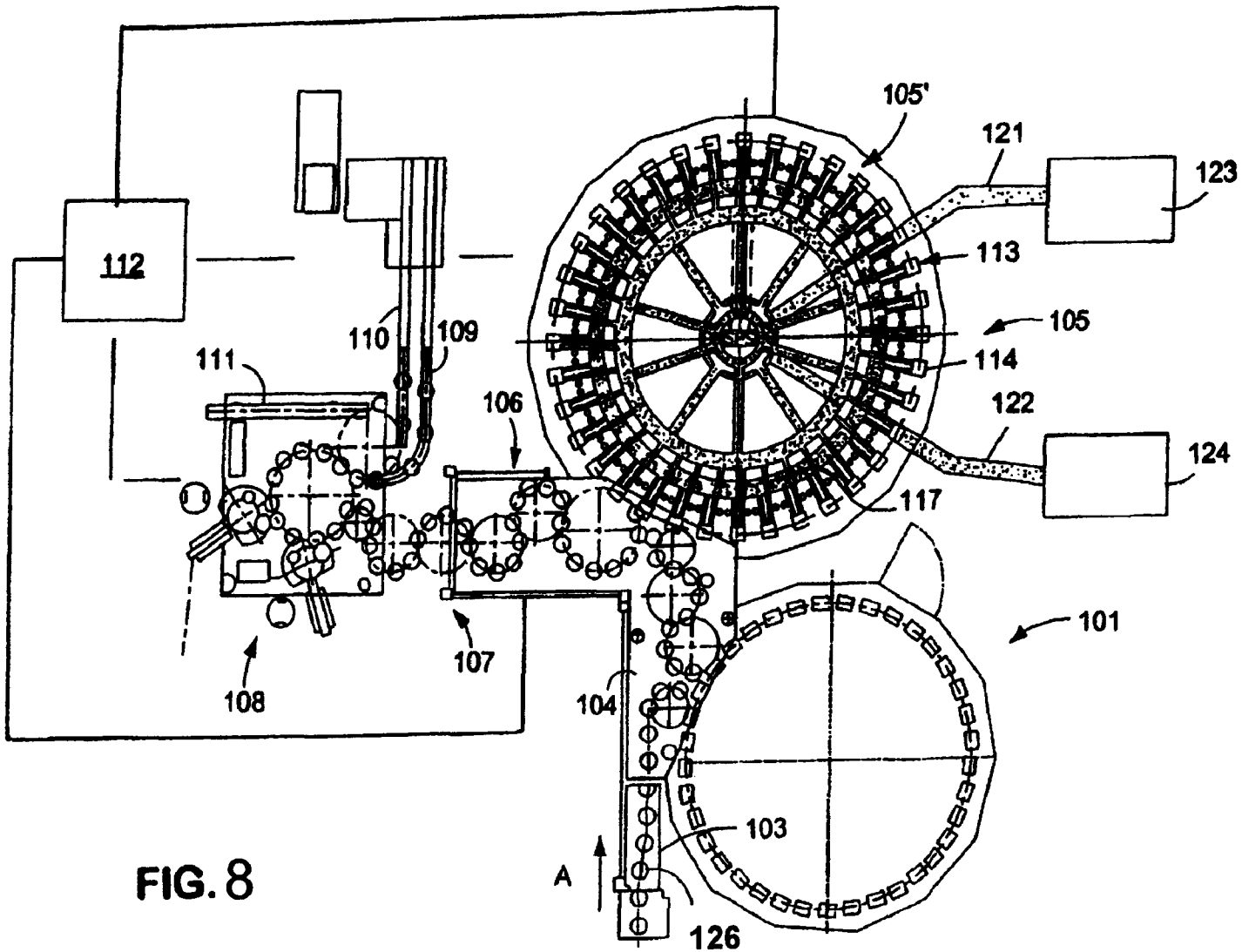
FIG. 8 shows schematically the main components of one possible embodiment example of a system for filling containers.

FIG. 8 shows schematically the main components of one possible embodiment example of a system for filling containers, possibly, a beverage bottling plant for filling bottles 2 with at least one liquid beverage, in accordance with at least one possible embodiment, in which system or plant could possibly be utilized at least one aspect, or several aspects, of the embodiments disclosed herein.

FIG. 8 shows a rinsing arrangement or rinsing station 101, to which the containers, namely bottles 2, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles 2 are transported to a beverage filling machine 105 by a second conveyer arrangement 104 that is formed, for example, by one or more starwheels that introduce bottles 2 into the beverage filling machine 105.

The beverage filling machine 105 shown is of a revolving or rotary design, with a rotor 105', which revolves around a central, vertical machine axis. The rotor 105' is designed to receive and hold the bottles 2 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 2 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 8, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles 2, there can be a beverage bottle closing arrangement or closing station 106 which closes or caps the bottles 2. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 2. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 2 to different locations.

The first output conveyer arrangement 109, in the embodiment shown, is designed to convey bottles 2 that are filled with a first type of liquid beverage supplied by, for example, the supply reservoir 123. The second output conveyer arrangement 110, in the embodiment shown, is designed to convey bottles 2 that are filled with a second type of liquid beverage supplied by, for example, the supply reservoir 124. The third output conveyer arrangement 111, in the embodiment shown, is designed to convey incorrectly labeled bottles 2. To further explain, the labeling arrangement 108 can comprise at least one beverage bottle inspection or monitoring device that inspects or monitors the location of labels on the bottles 2 to determine if the labels have been correctly placed or aligned on the bottles 2. The third output conveyer arrangement 111 removes any bottles 2 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 9:
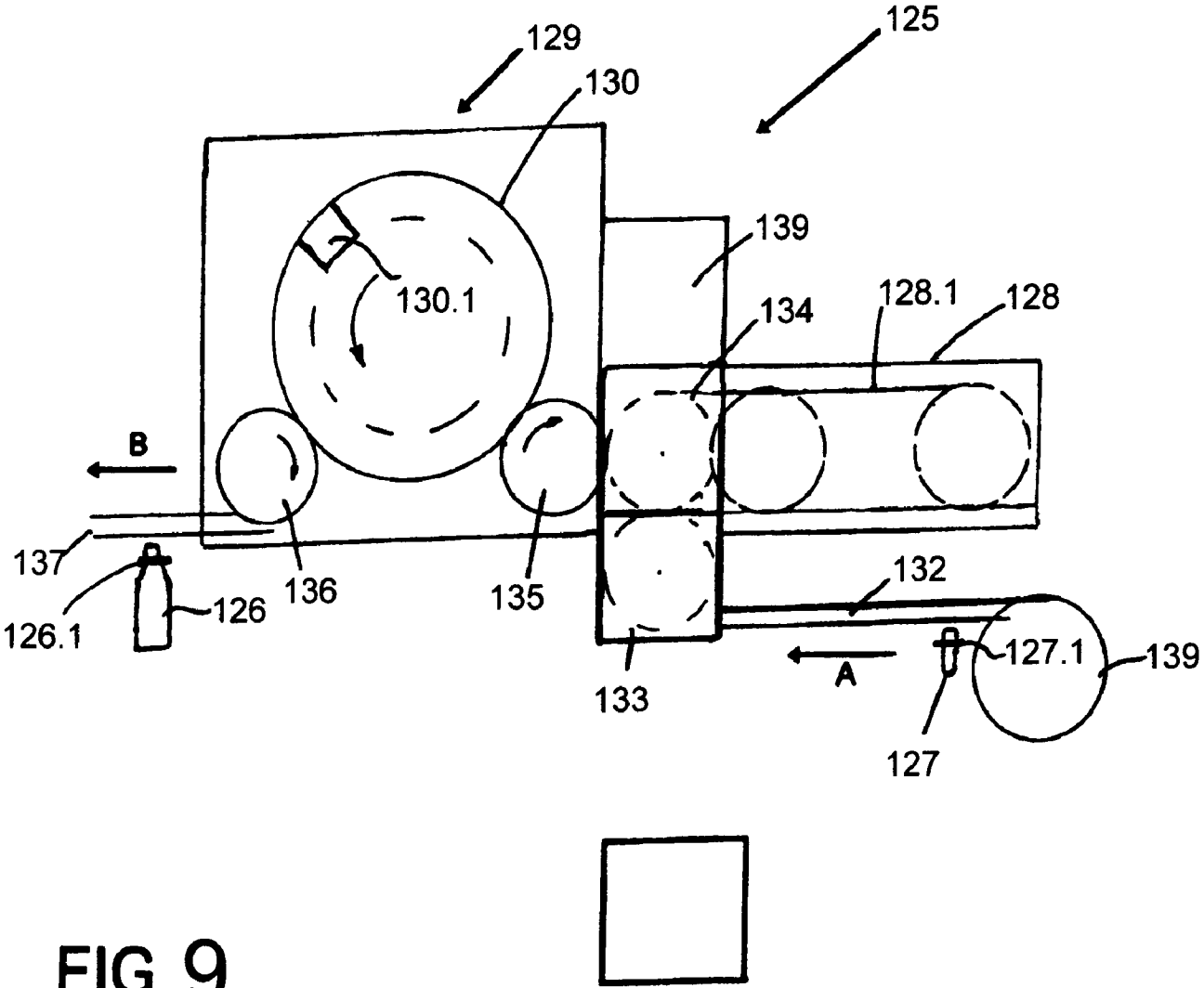
FIG. 9 shows in a simplified schematic view at least one embodiment of a stretch blow machine for the manufacture of plastic bottles from preforms by stretch blowing.

The stretch blow molding machine which is designated 125 in general in FIG. 9 is used for the manufacture of bottles 126 made of thermoplastic plastic, for example PET bottles, from preforms 127. For this purpose, the stretch blow molding machine 125 includes a furnace or a heating station 128 in which the preforms 127 are heated until they are at the temperature required for the subsequent stretch blowing, for example a temperature of approximately 135 degrees Celsius, and a blowing station 129 with a rotor or blow molding unit 130 that is driven so that it rotates around a vertical machine axis, on the periphery of which rotor or blow molding unit a plurality of blow molds 130.1 are provided, in each of which a preform 127 is molded by blowing into a bottle 126.

To describe the process in detail, during the normal operation of the stretch blow molding machine 125, the preforms are continuously fed by a feeder unit 131 via a conveyor line or feed line 132 as illustrated by Arrow A in FIG. 9. The feeder unit 131 has, among other things, a receiving container in which the preforms 127 are received in an unorganized group and from which the preforms 127 are each transferred to the feeder 132 in a specified orientation. In the feeder 132, the preforms 127 are held in a suspended position in a guide rail, for example on a projecting flange area 127.1, and are moved by compressed air in the direction of conveying or transport A, and possibly to an input 133 of the heating station 128. From the input 133, the preforms 127 travel to a transport element 128.1, with which they are each moved, one after another, through the heating station 128 to an output or transfer conveyor 134. This transfer conveyor 134 has, for example, at least one transport star wheel that is driven in rotation or a corresponding transport wheel for the heated preforms 127 and is realized with a switching function. The transport element 128.1 can be, for example, an endless circulating chain conveyor, on which receptacles for the preforms 127 are provided at a specified machine interval. The preforms 127 can be heated in the heating station 128 by radiant infrared heaters, for example.

Adjacent to the transfer conveyor 134 is an inlet or transport star wheel 135 of the blowing station 129, which star wheel 135 is driven in rotation. During normal operation, the heated preforms 127 are each transferred by means of this transport star wheel 135 one after another to a blow mold 130.1 of the blow molding unit 130 which is driven in rotation. The bottles 126 that are manufactured leave the blowing station 129 or the stretch blow molding machine 125 via an outlet star wheel and a downstream transport line 137, on which the bottles 126 are held suspended in a guide rail with a flange 126.1 formed by the flange segment 127.1 and the respective bottle mouth, and are transported by compressed air in the transport direction B to a downstream machine (not shown), e.g. to a filling machine.

To minimize the waste of material in the event of a problem in the operation of the downstream machine and to prepare bottles 126 for continued use after the resolution of a problem as soon as possible without any delay at the outlet of the stretch mold blowing machine 125, i.e. at the outlet star wheel 136 located at that point, in the possible embodiment illustrated in FIG. 9, the transfer conveyor 134 is realized so that in the event of a problem in the downstream machine and/or in the event of a backup of bottles in the transport line 137 caused by such a problem, it stops the onward transfer of the heated preforms 127 to the blow molding station 129 by means of a control device 138, and while the heating station 128 is still in operation—which continues to be loaded with preforms even in the event of the problem described above—continuously transfers the heated preforms outward and forwards them to a buffer storage device 139. This buffer storage device 139 is in the simplest case formed by a collecting containers container. The preforms 127 collected there can then be introduced into the feeder unit 131 or into the receptacle container located there for reuse. Between the transfer conveyor 134 and the buffer storage device 139, there can be a cooling line, for example, so that the outward-transferred preforms 127 can be cooled and therefore reach the buffer 139 or collecting container without the danger of deformation.

The advantage of the stretch blow molding machine 125 is that in the event of a problem in the downstream machine, only the blow molds 130.1 run empty and the bottles that are thereby produced must be outwardly transferred, for example, as well as the fact that the heating station 128 and the transport element 128.1 located there continue to be fully loaded with preforms 127, so that after the problem has been solved, the blowing station 129 is again supplied with heated preforms 127 via the transfer conveyor 134 and the inlet star wheel 135 without any delay.

Figure 10:
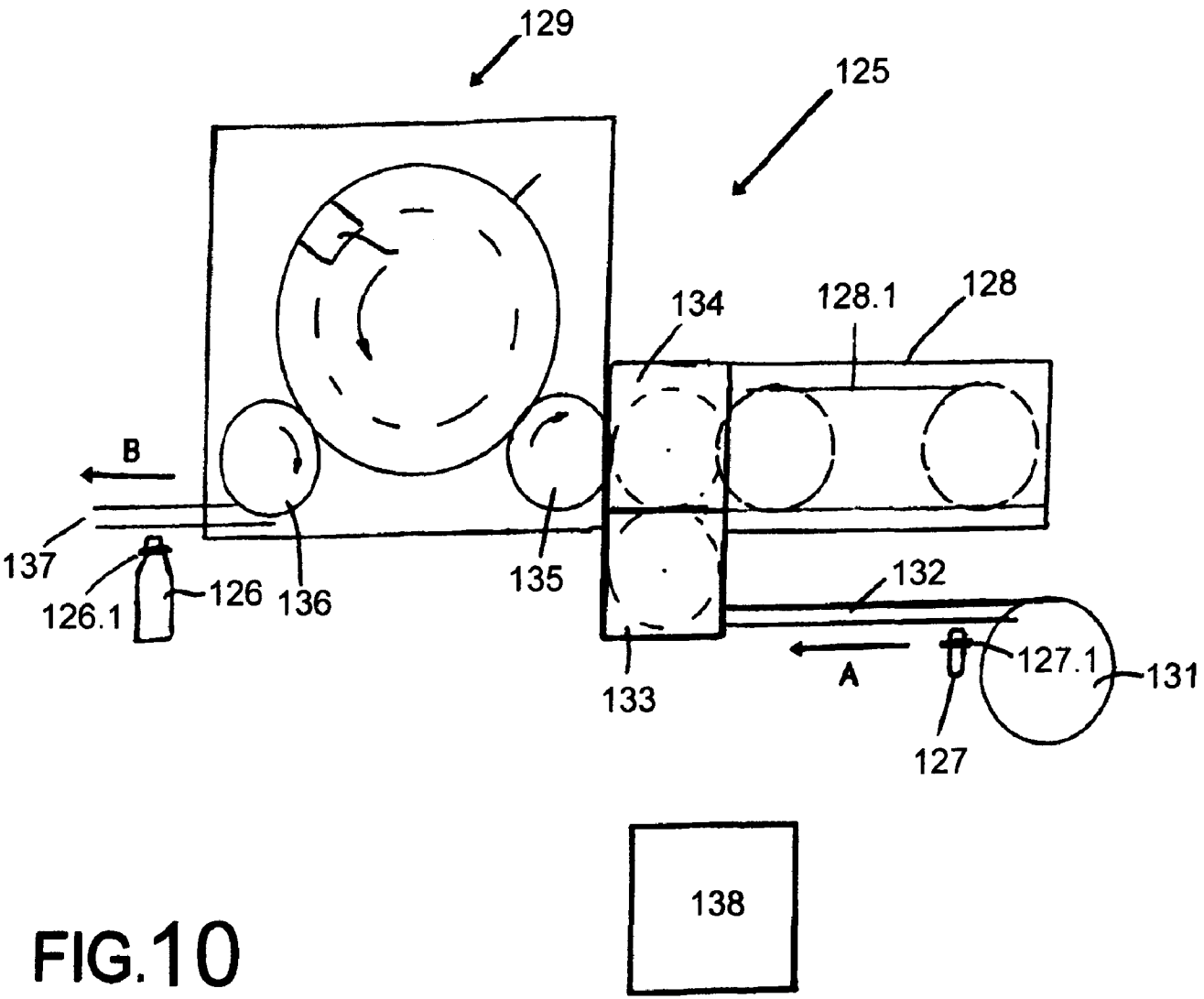
FIG. 10 shows in a simplified schematic view at least one other embodiment of a stretch blow machine for the manufacture of plastic bottles from preforms by stretch blowing.

FIG. 10 is a schematic illustration showing a stretch blow molding machine 125*a* which differs from the stretch blow molding machine 125 essentially in that, in the event of a problem with the downstream machine, for example with the downstream filling machine, and/or in the case of a bottle backup in the conveyor 137, the feed of the preforms to the heating station 128 is stopped in a controlled manner by the control device 138, and simultaneously the transfer conveyor 134 interrupts the forwarding of the heated preforms 127 to the blowing station 129, so that the preforms 127 that are located in the heating station 128 circulate in the heating station 128 until the problem with the transport element 128.1 is resolved. To thereby prevent an overheating of the preforms 127, the heat output of the heating station 128 is reduced and/or the transport line on which the preforms 127 are moved through the heating station 128, is at least partly cooled with cooling air. The reduction of the heat output and/or the cooling of the conveyor line with cooling air are done, however, so that at least after the elimination of a problem, the preforms 127 that, during their circulation in the heating station 128, reach the transfer conveyor 134, are at the temperature required for the stretch blow molding. When a problem is eliminated, therefore the blow molding of the bottles 126 can be resumed without any delay.

Both on the stretch blow molding machine 125 and on the stretch blow molding machine 125*a*, in the event of a problem the blowing station 129 is run empty and the bottles 2 that are thereby produced are then ejected, for example. During the problem and hold time, however, the nominal or working temperature of the blow molds 130.1 is maintained.

At least one possible embodiment of the present application is explained herein on the basis of exemplary embodiments. It goes without saying that numerous modifications and variants are possible without thereby going beyond the teaching of at least one possible embodiment of the present application. It is possible, for example, to realize the stretch blow molding machine 125 so that the preforms 127 that are outwardly transferred in the event of a problem at the transfer 134 are transported forward for reuse via a buffer storage device and via a transport system to the feeder unit 131 and/or to a second input of the input 133, which is realized in the form of a merge point.

It is also possible on the stretch blow molding machine 125 to reduce the heat output of the heating station during a problem and/or to cool the transport line on which the preforms 127 are moved through the heating station 128 with cooling air.

In the event of a problem it is also possible to outwardly transfer any preforms that are already inside the heating device 124 in at least one position of the conveyor line located inside the heating station 128. This process is generally advantageous, because certain types of preforms, depending on the material and geometric configuration, exhibit an undesirable crystallization behavior above a certain temperature. Because such a crystallization process begins only when a certain limit temperature is exceeded, such crystallization can be reliably prevented by outwardly transferring the preform at a point of the heating station or at such a time from the heating station 128 at which the preforms are still at a temperature that is below the limit temperature.

In the context of present application, the term "limit temperature" means not only the temperature at which the crystallization begins, but also the temperature at which the crystallization rate or the degree of crystallization of the preform reaches undesirable values.

Figure 11:
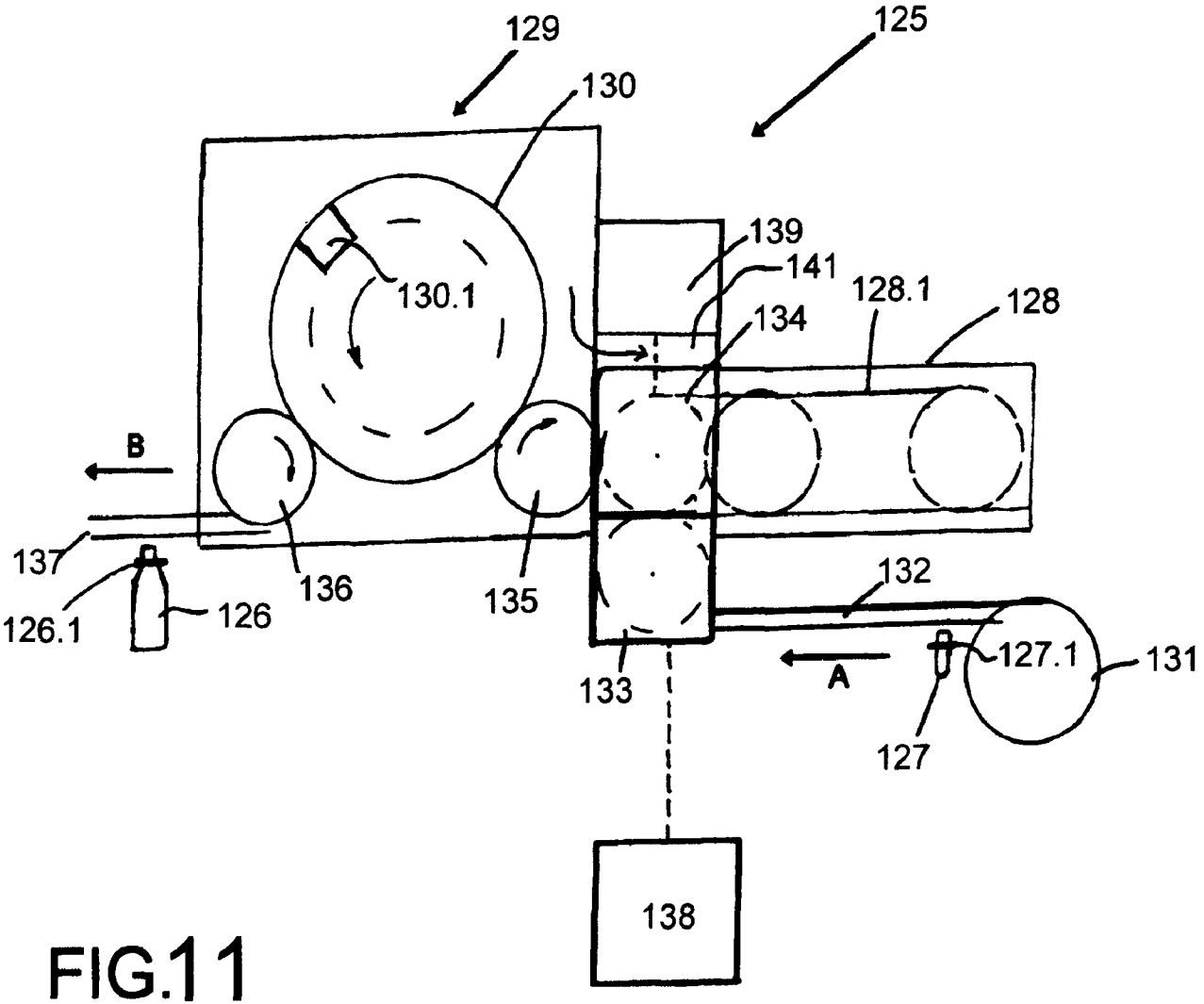
FIG. 11 shows another possible embodiment of the present application.

FIG. 11 shows another possible embodiment of the present application. This embodiment is similar to the one shown in FIG. 9. In the embodiment shown in FIG. 11, the stretch blow molding machine 125 is similar to that shown in FIG. 9 with additional optional features. In FIG. 11, the control device 138 is operatively connected to the stretch blow molding machine 125. In at least one possible embodiment, the control device 138 is a computer control device that is operatively connected to at least one or more components or machines of the stretch blow molding machine 125, or other components or machines in the overall beverage bottling plant, such as the plant in FIG. 8, to monitor and/or control the operation of such components or machines. The control device 138, in at least one other possible embodiment, could be part of or work in conjunction with another control device or system, such as the central control arrangement 112 in FIG. 8. The transfer conveyor 134, according to one possible embodiment, is designed with a switching function, that is, the transfer conveyor 134 can be actuated to switch between conveying preforms 127 to the blowing station 129 and to the buffer or collecting container 139. This switching can be actuated by the control device 138 upon the development of a problem in the operation of the downstream machine and to prepare bottles 126 for continued use after the resolution of a problem as soon as possible with minimal delay. The collecting container 139 in the embodiment shown in FIG. 11 has an output arrangement 140 and a cooling arrangement 141. In operation, preforms 127 could be conveyed from the transfer conveyor 134 to the storage arrangement 139 via the output arrangement 140, which output arrangement 140 has a linear or rotary conveyor arrangement, or a combination thereof. The output arrangement 140, in at least one possible embodiment, can also have a movable transfer arm or other guiding arrangement. The guiding arrangement can be actuated by a signal from the control device 138 during an interruption in the downstream bottling process to divert the preforms 127 out of the conveyor 134 and to the storage arrangement 139. When the interruption has been corrected or overcome, the guiding arrangement can be taken out of engagement with the conveyor 134 to permit the preforms 127 to continue on their normal path to the inlet star wheel 135. Upon removal of the preforms 127 from the conveyor 134, the preforms 127 are collected in the storage arrangement 139 and then can be taken to the feeder unit 131 or placed into a receptacle container located by the feeder unit for reuse. In one possible embodiment, the storage arrangement 139 has a removable container that can be removed when it is substantially filled with preforms 127. The container could then be taken, either manually or by mechanical means, such as a forklift, to the feeder unit 131 or to a storage area where the supply of preforms 127 is stored. While the full container is being transported, an empty container could be placed in the storage arrangement 139 to collect preforms 127 during an interruption in the bottling process. In addition, between the transfer conveyor 134 and the buffer storage device 139, there can be a cooling arrangement 141, for example, so that the outward-transferred preforms 127 can be cooled and therefore reach the buffer 139 or collecting container without the danger of deformation. The cooling arrangement 141 could have blowers or other cooling elements to cool the heated preforms 127 prior to their placement in the storage device 139.

Figure 12:
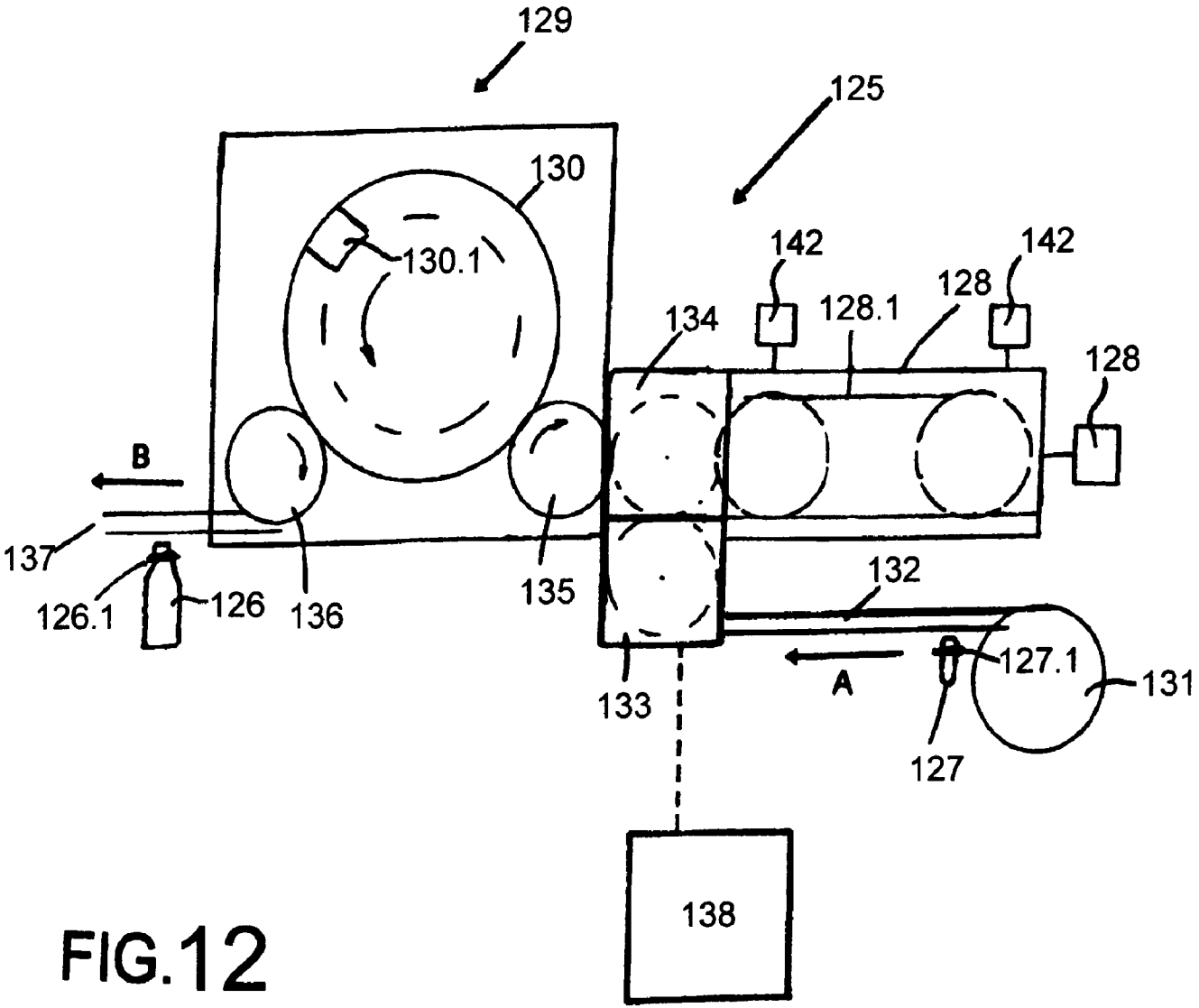
FIG. 12 shows a further possible embodiment of the present application.

FIG. 12 shows another possible embodiment of the present application. This embodiment is similar to the one shown in FIG. 10. In the embodiment shown in FIG. 12, the stretch blow molding machine 125 is similar to that shown in FIG. 10 with additional features. The heating station 128 has at least one heater 144 and at least one cooling device 142. The heater 144 heats the preforms and the cooling device 142 helps maintain the temperature of the preforms 127 to minimize overheating during an interruption downstream in the bottling process.

Figure 13:
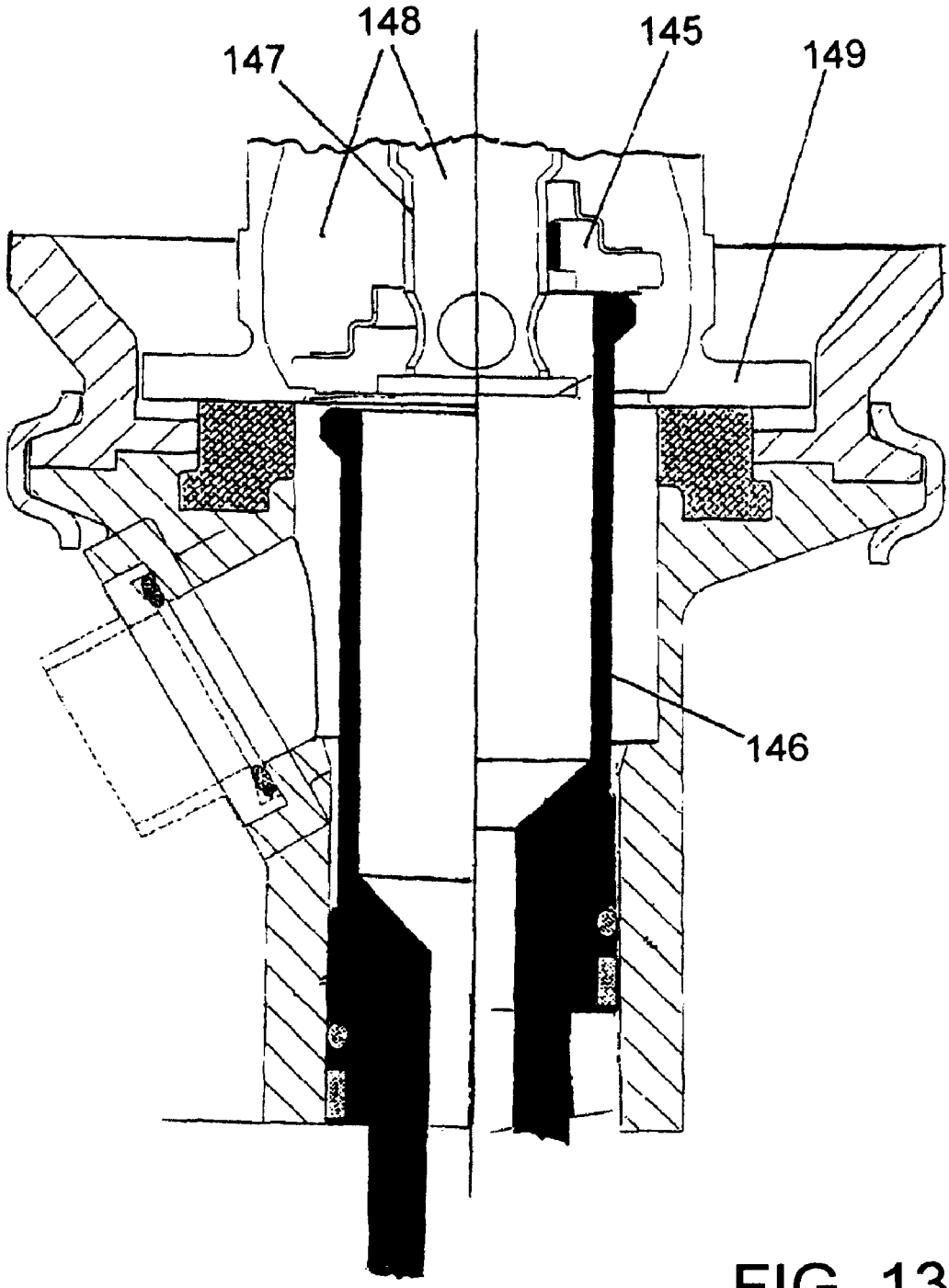
FIG. 13 is a simplified drawing in section of a handling head for flat fittings that is part of the prior art.

FIG. 13 shows a flat fitting 149. The flat fitting 149 illustrated in FIG. 13 has essentially a plate-shaped or disc-shaped configuration, whereby it comprises a movable valve 145 in the shape of a circular ring. This valve 145 is actuated by a hollow cup plunger 146 which enters into a sealed connection with the valve 145 and substantially simultaneously establishes the media connections to the filler tube 147 and the keg interior 148. The procedure is clearly illustrated in FIG. 13, whereby the left half of FIG. 13 shows the closed position and the right half an open position.

Figure 14:
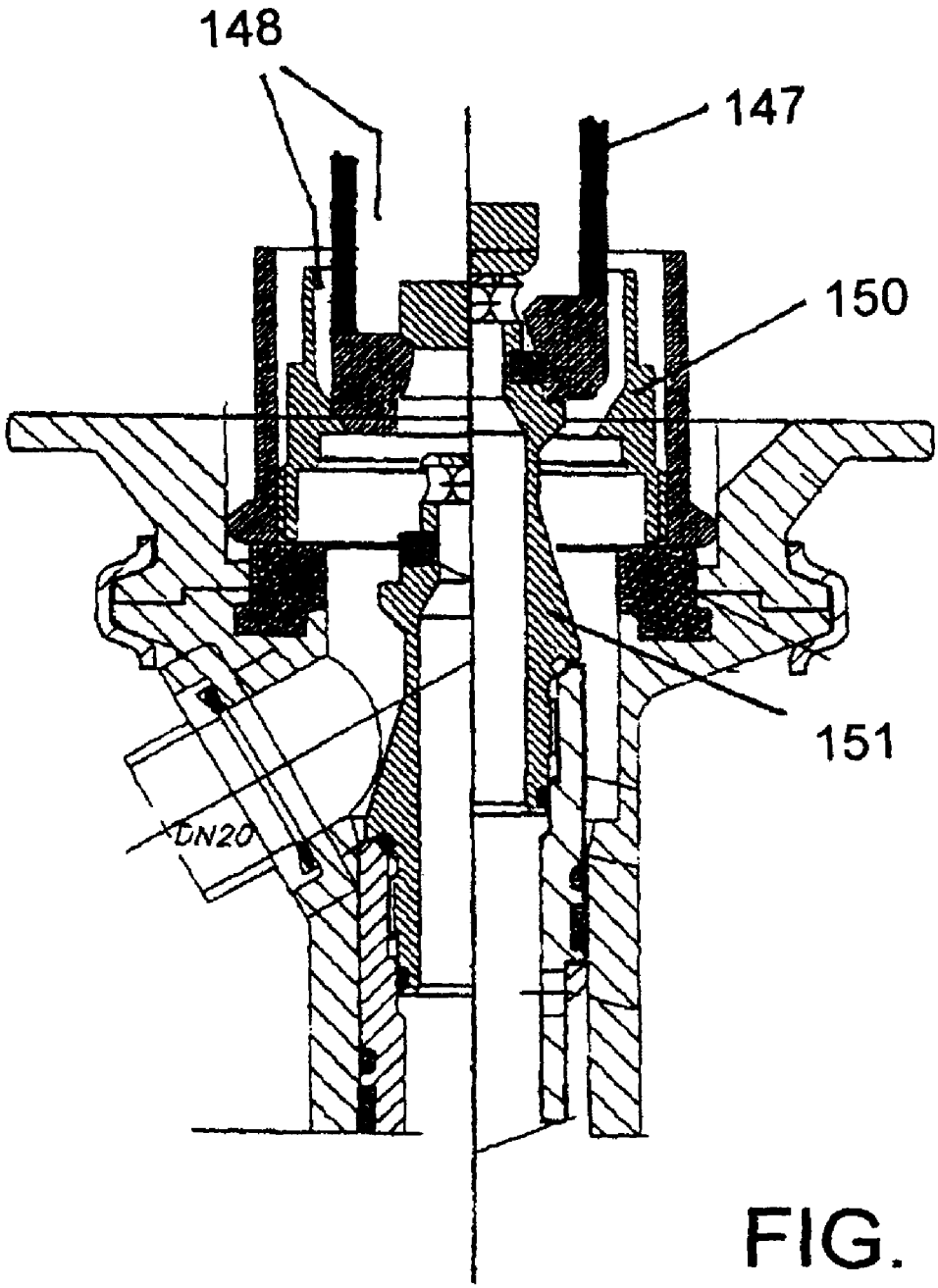
FIG. 14 is also a simplified drawing in section of a handling head for basket fittings that is part of the prior art.

FIG. 14 shows a basket fitting 149. The basket fitting 150 illustrated in FIG. 14 has the form of a plurality of circular rings located inside a cylinder, whereby in the middle of these circular rings there is a closing element in the shape of a circular ring. When the basket fitting 150 is used, the circular closing element and the innermost circular ring form the moving valve elements. These elements are raised and actuated by a graduated plunger 151, as a result of which the connections to the keg interior 148 are established.

Figure 15:
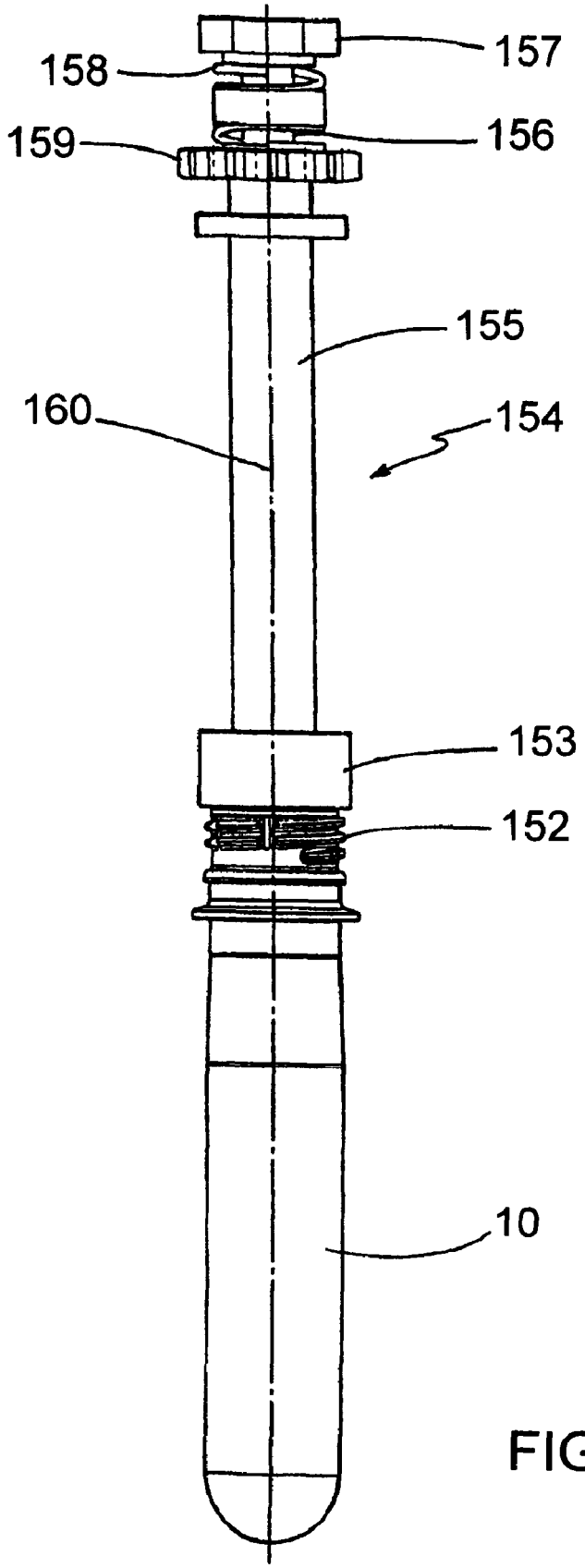
FIG. 15 is shows a side view of a preform, into which is inserted a support element that can be tightened.

FIG. 15 shows a side view of a preform 10, into whose mouth section 152 a support element 154 is partly inserted. Near its end that faces the preform 10, the support element 154 has a contact element 153, which is mounted on a sleeve-like base element 155. A positioning element 156, which can move relative to the base element 155 in the direction of a longitudinal axis 160, is guided inside the base element 155. In the area of its extension at the opposite end from the preform 10, the base element 155 holds a closure element 159, which is designed as a gear in the possible embodiment illustrated in FIG. 15. A stop element 157 of the positioning element 156 is supported by a spring 158 opposite the closure element 159. In the illustrated embodiment, the spring 158 is designed as a tension spring and allows displacement of the positioning element 156 inside the base element 155 in the direction towards the preform 10. After completion of the application of a tensile force on the positioning element 156, the positioning element is returned to a base position by the spring 158.

Figure 16:
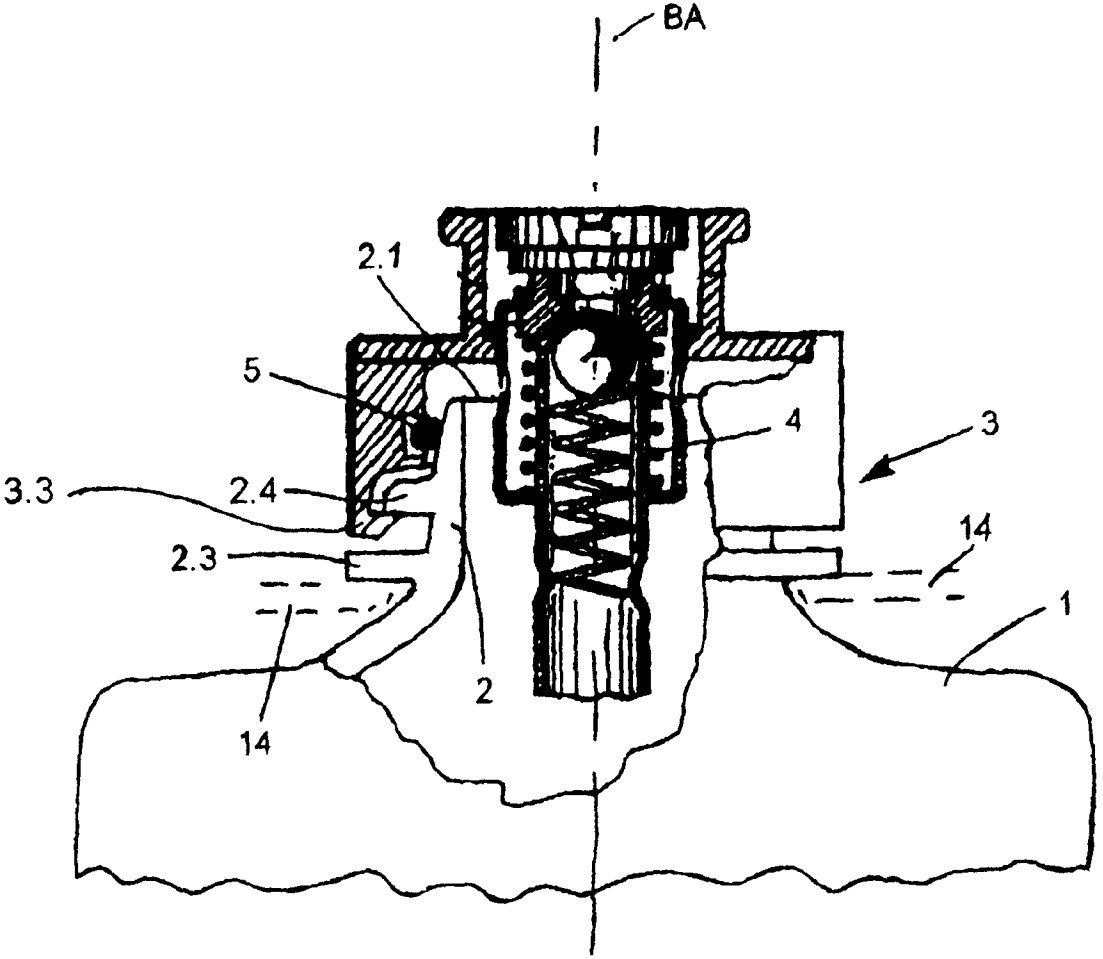
FIG. 16 is a partial illustration of a container (PET keg) in the vicinity of the mouth of the keg, together with a non-reusable screw fitting provided on the mouth of the keg, shown in partial section.

FIG. 16 shows a large-volume container which is manufactured by blow molding from a plastic material, possibly PET, and in one possible embodiment, for example, in the form of a non-reusable container with a volume of 10 to 20 liters. The container 1 filled with a liquid to be bottled, e.g. mineral water, table water, beer, or a similar beverage, is tightly closed by a non-reusable fitting 3 in the vicinity of its top container mouth 2.1, which, as shown in FIG. 16, is formed in the shape of a container neck 2. In the illustrated embodiment, the fitting 3 is generally made or may be made of plastic with a fitting valve insert 4 made of stainless steel and is essentially permanently sealed to a flange 2.4 formed on the container neck with the use of both a gasket 5 and a fitting protrusion 3.3 by screwing.

One feature or aspect of an embodiment is believed at the time of the filing of this patent application to possibly reside broadly in the method for the formation of packaging units, each comprising a container 1 closed with a keg fitting 3 and filled with a liquid to be bottled, wherein by at least the following process steps:

Preparation of the respective plastic container 1,

Feed and insertion of the respective fitting 3 into a container opening 2.1, Manufacture of a tight connection between the container 1 and the fitting 3, and Filling of the container 1 with the liquid to be bottled, generally with containers 1 oriented with their fittings 3 on top.

Another feature or aspect of an embodiment is believed at the time of the filing of this patent application to possibly reside broadly in the method wherein the respective container 1 is realized in the form of a non-reusable keg.

Yet another feature or aspect of an embodiment is believed at the time of the filing of this patent application to possibly reside broadly in the method wherein the respective fitting 3 is realized in the form of a non-reusable fitting 3.

Still another feature or aspect of an embodiment is believed at the time of the filing of this patent application to possibly reside broadly in the method wherein the containers used are large-volume containers, for example containers with a volume of 10-20 liters.

A further feature or aspect of an embodiment is believed at the time of the filing of this patent application to possibly reside broadly in the method wherein the preparation of the containers 1, the feed and placement of the fittings 3 on the containers 1, the connection of the fittings 3 with the containers 1 and the filling of the containers are each performed in chronological sequence immediately or substantially immediately after one another in a plant 6.

Another feature or aspect of an embodiment is believed at the time of the filing of this patent application to possibly reside broadly in the method wherein the containers 1 are prepared by blow-molding of these containers.

Yet another feature or aspect of an embodiment is believed at the time of the filing of this patent application to possibly reside broadly in the method wherein the containers 1 are each filled in a filling machine 20.

Still another feature or aspect of an embodiment is believed at the time of the filing of this patent application to possibly reside broadly in the method wherein the connection between the containers 1 and the fittings 3 also takes place inside the filling machine 20.

A further feature or aspect of an embodiment is believed at the time of the filing of this patent application to possibly reside broadly in the method wherein the feed and placement of the fittings 3 on the containers 1 takes place inside the filling machine 20.

Another feature or aspect of an embodiment is believed at the time of the filing of this patent application to possibly reside broadly in the method wherein the feed and placement of the fittings 3 on the containers 1 and the creation of the connection between the fittings 3 and the containers 1 takes place in a station 15, 18 or machine that is upstream of the filling machine 20.

Yet another feature or aspect of an embodiment is believed at the time of the filing of this patent application to possibly reside broadly in the method wherein the connection between the containers 1 and the fittings 3 is made by screwing the fittings onto the containers 1.

Another feature or aspect of an embodiment is believed at the time of the filing of this patent application to possibly reside broadly in the method wherein the connection of the fittings 3 to the containers 1 is created by pressing and/or locking the fittings 3 onto the containers 1.

Yet another feature or aspect of an embodiment is believed at the time of the filing of this patent application to possibly reside broadly in the device for the formation of packaging units, each comprising a container 1 closed with a keg fitting 3 and filled with a liquid to be bottled, with at least one filling position with a filling element 21, against which the respective container 1 to be filled and held on a container carrier 14 can be pressed with its fitting 3 for the filling process by relative movement between the filling element 21 and the container carrier 14, wherein by at least one tool 19 on the filling position for the creation of the connection between the respective container 1 and the fitting prior to the filling process.

Still another feature or aspect of an embodiment is believed at the time of the filing of this patent application to possibly reside broadly in the device wherein the at least one tool 19 is realized in the form of a compression or pressing tool 19 for the creation of a connection between the fittings 3 and the containers 1 by pressing and/or locking.

A further feature or aspect of an embodiment is believed at the time of the filing of this patent application to possibly reside broadly in the device wherein the at least one tool is realized for the creation of a threaded connection between the containers 1 and the fittings 3.

Another feature or aspect of an embodiment is believed at the time of the filing of this patent application to possibly reside broadly in the device wherein by a machine or station 15 upstream of the filling machine 20, in which the fittings 3 are fed to the containers 1 and placed on the containers 1.

Yet another feature or aspect of an embodiment is believed at the time of the filing of this patent application to possibly reside broadly in the device wherein by the realization of the filling machine 20 in the form of a linear design.

Still another feature or aspect of an embodiment is believed at the time of the filing of this patent application to possibly reside broadly in the device wherein by the realization of the filling machine 20 in the form of a filling machine 20 with a rotary construction.

A further feature or aspect of an embodiment is believed at the time of the filing of this patent application to possibly reside broadly in the device wherein by means on the filling machine 20 for the feed of the fittings 3 and for the placement of the fittings 3 on the containers 1 inside the filling machine.

The present application relates to a method for the formation of packing units, each comprising a container filled with a liquid to be bottled and closed with a keg fitting.

The components disclosed in the various publications, disclosed or incorporated by reference herein, may possibly be used in possible embodiments of the present invention, as well as equivalents thereof.

The purpose of incorporating U.S. patents, Foreign patents, publications, etc. is solely to provide additional information relating to features of one or more embodiments, which information may not be completely disclosed in the wording in the pages of this application.

The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign and international patent publication applications, namely, Federal Republic of Germany Patent Application No. 10 2006 026 279.4, filed on Jun. 2, 2006, having inventor Alois MONZEL, and DE-OS 10 2006 026 279.4 and DE-PS 10 2006 026 279.4, and International Application No. PCT/EP2007/004600, filed on May 24, 2007, having WIPO Publication No. WO2007/140884 A2 and inventor Alois MONZEL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/004600 and Federal Republic of Germany Patent Application No. 10 2006 026 279.4 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/004600 and Federal Republic of Germany Patent Application No. 10 2006 026 279.4 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

At least one possible embodiment of the present application relates to a stretch blow mold machine for the manufacture of hollow bodies, generally bottles, by stretch blowing using preforms made of thermoplastic plastic, with a preheating station for the preheating of the preforms fed to this station and with a blowing station that has at least one blow mold.

This application also relates to a stretch blow molding machine and method for the manufacture of bottles or similar hollow bodies.

One feature or aspect of an embodiment is believed at the time of the filing of this patent application to possibly reside broadly in a stretch blow molding machine for the manufacture of hollow bodies, generally bottles 126, by stretch blowing with the use of preforms 127 made of thermoplastic plastic, with a heating station 128 for the preheating of the preforms 127 that are fed to this station, and with a blowing station 129 that has at least one blow mold 130.1, to which the preforms 127 heated in the heating station 128 are fed, comprising means 134 which, in the event of a problem in the blowing station 129 and or in a part of the plant that processes the hollow bodies downstream of the blowing machine, outwardly transfers at least some of the heated preforms 127 while the heating station 128 remains in operation.

Another feature or aspect of an embodiment is believed at the time of the filing of this patent application to possibly reside broadly in the stretch blow molding machine, comprising means 133, 134 that, in the event of a problem in the blowing station 129 and/or in a part of the plant that processes the hollow bodies downstream of the blowing machine, as the heating station 128 continues to operate, block the feed of the preforms 127 to the heating station 128 and the transfer of preforms 127 from the heating station 128 to the blowing station 129.

Yet another feature or aspect of an embodiment is believed at the time of the filing of this patent application to possibly reside broadly in a stretch blow molding machine for the manufacture of hollow bodies, generally bottles 126, by stretch blowing using preforms 127 made of thermoplastic plastic with a heating station 128 for the preheating of the preforms 127 that are fed to this station, as well as with a blowing station 129 that has at least one blow mold 130.1, to which blowing station the preforms 127 heated in the heating station 128 are fed, comprising means 133, 134 that in the event of a problem in the blowing station 129 and/or in a part of a plant that processes the hollow bodies downstream of the blowing machine, as the heating station 128 remains in operation, block the feed of the preforms 127 to the heating station 128 and the transfer of preforms 127 from the heating station 128 to the blower station 5.

Still another feature or aspect of an embodiment is believed at the time of the filing of this patent application to possibly reside broadly in the stretch blow molding machine, comprising means 134 which, in the event of a problem in the blowing station 129 and/or in a part of the plant that processes the hollow bodies downstream of the blowing machine, as the heating station 128 continues to operate, effect an outward transfer of at least some of the heated preforms 127.

A further feature or aspect of an embodiment is believed at the time of the filing of this patent application to possibly reside broadly in the stretch blow molding machine, comprising a transfer conveyor 134 located between an outlet of the heating station 128 and an inlet of the blowing station 129, which can be controlled so that in the event of a problem it interrupts the forward transport of the heated preforms 127 to the blowing station 129.

Another feature or aspect of an embodiment is believed at the time of the filing of this patent application to possibly reside broadly in the stretch blow molding machine, wherein the transfer conveyor 134 outwardly transfers the heated preforms 127, for example to a buffer 139 or collecting container.

Yet another feature or aspect of an embodiment is believed at the time of the filing of this patent application to possibly reside broadly in the stretch blow molding machine, wherein in the event of a problem, the transfer conveyor 134 blocks the heating station 128 for the delivery of the preforms 127 to the blowing station 129.

Still another feature or aspect of an embodiment is believed at the time of the filing of this patent application to possibly reside broadly in the stretch blow molding machine, wherein the heating station 128 has at least one driven endless circulating transport element 128.1 for the preforms 127.

A further feature or aspect of an embodiment is believed at the time of the filing of this patent application to possibly reside broadly in the stretch blow molding machine, wherein the blowing station 129 has at least one rotor 130 that can be driven in rotation around a vertical machine axis with a plurality of blow molds 6 that are provided on the rotor periphery.

Another feature or aspect of an embodiment is believed at the time of the filing of this patent application to possibly reside broadly in the stretch blow molding machine, wherein it is interlocked with a downstream machine, generally with a downstream filling machine.

Yet another feature or aspect of an embodiment is believed at the time of the filing of this patent application to possibly reside broadly in a method for the manufacture of bottles 126 or similar hollow bodies by stretch blow molding using preforms 127 made of thermoplastic plastic, whereby the preforms 127 are heated in a heating station 128 and are deformed in the heated state in a blow mold 130.1 of a blowing station 129 into the individual hollow bodies, wherein in the event of a problem in the blowing station 129 and/or in a part of the plant that processes the hollow bodies downstream of the stretch blow molding machine 125, 1*a*, the onward transfer of the heated preforms 127 to the blowing station is interrupted and at least some of the preforms 127 are transferred outward for reuse.

Still another feature or aspect of an embodiment is believed at the time of the filing of this patent application to possibly reside broadly in the method, wherein in the event of a problem, at least some of the preforms 127 are retained in the heating station 128 or are moved into a self-contained holding loop inside the heating station 128.

A further feature or aspect of an embodiment is believed at the time of the filing of this patent application to possibly reside broadly in the method for the manufacture of bottles 126 or similar hollow containers by blow molds using preforms 127 made of thermoplastic plastic, whereby the preforms 127 are heated in a heating station 128 and in the heated state are deformed in a blow mold 130.1 of a blowing station 129 into the individual hollow bodies, wherein in the event of a problem, at least some of the preforms 127 are retained in the heating station 128 or are moved into a self-contained holding loop inside the heating station 128.

Another feature or aspect of an embodiment is believed at the time of the filing of this patent application to possibly reside broadly in the method, wherein in the event of a problem in the blowing station 129 and/or in a portion of the plant that processes the hollow bodies downstream of the stretch blow molding machine 125, 125*a*, the onward transfer of the heated preforms 127 to the blowing station is interrupted and at least some of the preforms 127 are transferred outward for reuse.

Yet another feature or aspect of an embodiment is believed at the time of the filing of this patent application to possibly reside broadly in the method, wherein the preforms 127 are transferred outward to a buffer storage device 139 or to a receiving or collecting container.

Still another feature or aspect of an embodiment is believed at the time of the filing of this patent application to possibly reside broadly in the method, wherein in the event of a problem, the preforms 127 are moved on at least one endless circulating driven transport element 128.1 of the heating station 128.

A further feature or aspect of an embodiment is believed at the time of the filing of this patent application to possibly reside broadly in the method, wherein in the event of a problem, the heat output of the heating station 128 is reduced and/or that the transport line on which the preforms 127 are moved through the heating station is cooled with cooling air.

Another feature or aspect of an embodiment is believed at the time of the filing of this patent application to possibly reside broadly in the method, wherein in the event of a problem, the blowing station 129 is run empty and as long as the problems persist or during the hold time until the problem is resolved, the at least one blow mold 130.1 is held at the nominal and operating temperature.

All of the patents, patent applications or patent publications, which were cited in the International Search Report dated Jan. 29, 2008, and/or cited elsewhere are hereby incorporated by reference as if set forth in their entirety herein as follows: U.S. Pat. No. 5,720,148 issued to Olivier BEDIN, ET AL on Feb. 24, 1998; DE 3434023 issued to SEITZ ENZINGER NOLL MASCH on Mar. 27, 1986; GB 06970 A. A.D. 1904 (GB 190406970) issued to Frank Eugene KEYES on Sep. 1, 1904; and DE 102 45 318 issued to Bernd HANSEN on Apr. 8, 2004.

U.S. patent application Ser. No. 11/690,624, filed on Mar. 23, 2007, which issued on Aug. 11, 2009, as U.S. Pat. No. 7,571,585, and its corresponding Federal Republic of Germany Patent Application No. 10 2006 013 843.0-16, filed on Mar. 25, 2006, are hereby incorporated by reference as if set forth in their entirety herein.

U.S. patent application Ser. No. 11/886,381, filed on Dec. 23, 2005, which issued on Mar. 9, 2010, as U.S. Pat. No. 7,571,585, and its corresponding Federal Republic of Germany Patent Application No. 10 2005 011 805.4, filed on Mar. 15, 2005, are hereby incorporated by reference as if set forth in their entirety herein.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" U.S. Pat. No. 7,024,841, entitled "Labeling Machine with a Sleeve Mechanism for Preparing and Applying Cylindrical Labels onto Beverage Bottles and Other Beverage Containers in a Beverage Container Filling Plant;" U.S. Pat. No. 6,971,219 entitled "Beverage bottling plant for filling bottles with a liquid beverage filling material and a labelling station for labelling filled bottles and other containers;" U.S. Pat. No. 6,973,767, entitled "Beverage bottling plant and a conveyor arrangement for transporting packages;" U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 7,108,025, entitled "Beverage Bottling Plant for Filling Bottles with a Liquid Beverage Filling Material, and a Container Filling Lifting Device for Pressing Containers to Container Filling Machines;" U.S. Pat. No. 7,062,894, entitled "Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" U.S. Pat. No. 7,010,900, entitled "Beverage Bottling Plant for Filling Bottles with a Liquid Beverage Filling Material, and a Cleaning Device for Cleaning Bottles in a Beverage Bottling Plant;" U.S. Pat. No. 6,918,417, entitled "A Beverage Bottling Plant for Filling Bottles with a Liquid Beverage Filling Material, and an Easily Cleaned Lifting Device in a Beverage Bottling Plant;" U.S. Pat. No. 7,065,938, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" U.S. Pat. No. 6,901,720, entitled "A Beverage Bottling Plant for Filling Bottles with a Liquid Beverage Filling Material, and Apparatus for Attaching Carrying Grips to Containers with Filled Bottles;" and U.S. Pat. No. 7,121,062 "Beverage bottling plant for filling bottles with a liquid beverage filling material, having a container handling machine with interchangeable receptacles for the container mouth."

Some examples of bottling and container handling systems and components thereof which may possibly be utilized or adapted for use in at least one possible embodiment, may possibly be found in the following U.S. patent applications: Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004,entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/954,012, filed on Sep. 29, 2004, Ser. Nos. 10/952,706, 10/962,183, filed on Oct. 8, 2004, Ser. No. 10/967,016, filed on Oct. 15, 2004, Ser. No. 10/982,706, filed on Nov. 5, 2004, Ser. Nos. 10/982,694, 10/982,710, 10/984,677, filed on Nov. 9, 2004, Ser. No. 10/985,640, filed on Nov. 10, 2004, Ser. No. 11/004,663, filed on Dec. 3, 2004, Ser. No. 11/009,551, filed on Dec. 10, 2004, Ser. No. 11/012,859, filed on Dec. 15, 2004, Ser. No. 11/014,673, filed on Dec. 16, 2004, Ser. No. 11/016,364, filed on Dec. 17, 2004, and Ser. No. 11/016,363.

Some examples of bottling systems, which may be used or adapted for use in at least one possible embodiment of the present may be found in the following U.S. patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

Some examples of control systems which measure operating parameters and learn therefrom that may possibly be utilized or possibly adapted for use in at least one possible embodiment of the present application may possibly be found in the following U.S. patents: U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

Some examples of interface arrangements that may possibly be utilized or possibly adapted for use in at least one possible embodiment of the present application may possibly be found in the following U.S. patents: U.S. Pat. No. 5,001,704 issued to Narup et al. on Mar. 19, 1991; U.S. Pat. No. 5,961,356 issued to Fekete on Oct. 5, 1999; U.S. Pat. No. 6,621,692 issued to Johnson et al. on Sep. 16, 2003; U.S. Pat. No. 6,661,961 issued to Allen et al. on Dec. 9, 2003; U.S. Pat. No. 6,687,166 issued to Takahashi et al. on Feb. 3, 2004; and U.S. Pat. No. 6,687,779 issued to Sturm et al. on Feb. 3, 2004.

Some examples of computer systems that may possibly be utilized or possibly adapted for use in at least one possible embodiment of the present application may possibly be found in the following U.S. patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

Some examples of bottle or container molding or manufacturing systems, and components thereof, which may possibly be utilized or adapted for use in at least one possible embodiment may possibly be found in the following U.S. patents: U.S. Pat. No. 7,157,040, entitled "Helical blow molding preform and method of manufacturing;" U.S. Pat.

No. 7,153,127, entitled "Method and apparatus for blow molding hollow plastic containers;" U.S. Pat. No. 7,147,456, entitled "Mold device having a combination of molds for stretch blow molding;" U.S. Pat. No. 7,131,830, entitled "Blow molding machine;" U.S. Pat. No. 7,129,317, entitled "Slow-crystallizing polyester resins;" U.S. Pat. No. 7,118,005, entitled "Individual bottle coolers;" U.S. Pat. No. 7,115,309, entitled "Synthetic resin preform to be biaxially stretched and blow molded into a bottle;" U.S. Pat. No. 7,114,945, entitled "Blow mold device;" U.S. Pat. No. 7,101,506, entitled "Takeout and transfer apparatus and method for a wheel blow molding machine;" U.S. Pat. No. 7,101,170, entitled "Take-out device for rotary blow molding machine;" U.S. Pat. No. 7,097,060, entitled "Container with non-everting handgrip;" U.S. Pat. No. 7,094,863, entitled "Polyester preforms useful for enhanced heat-set bottles;" U.S. Pat. No. 7,093,411, entitled "Method for storing thermoplastic preforms in a container;" U.S. Pat. No. 7,083,407, entitled "Preform holding jig for biaxial orientation blow molding;" U.S. Pat. No. 7,081,285, entitled "Polyethylene useful for blown films and blow molding;" U.S. Pat. No. 7,033,162, entitled "Injection blow molding device;" U.S. Pat. No. 7,001,172, entitled "Clamping device for injection blow or injection stretch blow molding machine;" U.S. Pat. No. 6,971,864, entitled "Device for producing plastic hollow bodies using an extrusion blow molding method;" U.S. Pat. No. 6,888,103, entitled "Preform preheater;" U.S. Pat. No. 6,851,944, entitled "Mold tool clamping device for blow mold machines;" U.S. Pat. No. 6,848,900, entitled "Apparatus for handling injection molded preforms;" U.S. Pat. No. 6,848,899, entitled "Injection stretch blow molding device with transfer station and pitch changing for blow molding;" U.S. Pat. No. 6,848,896, entitled "Height adjusting device for adjusting the height of a blow mandrel;" U.S. Pat. No. 6,843,646, entitled "Nickel blow mold and holder defining heat transfer passages therebetween;" U.S. Pat. No. 6,839,652, entitled "Method and device for predicting temperature profiles throughout the thickness of a polymer preform;" U.S. Pat. No. 6,820,396, entitled "Method for storing thermoplastic preforms in a container;" and U.S. Pat. No. 6,814,922, entitled "Method and device for production of a blown container."

All of the patents, patent applications or patent publications, which were cited in the German Office Action dated Nov. 10, 2006, and/or cited elsewhere are hereby incorporated by reference as if set forth in their entirety herein as follows: German Patent No. 695 27 216 T2, German Patent No. 696 01 495 T2, and German Patent No. 198 24 846 A1.

The corresponding foreign and international patent publication applications, namely, Federal Republic of Germany Patent Application No. 10 2006 013 843, filed on Mar. 25, 2006, having inventor Volker TILL, and DE-OS 10 2006 013 843 and DE-PS 10 2006 013 843, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of cooling arrangements that may possibly be utilized or possibly adapted for use in at least one possible embodiment of the present application may possibly be found in the following U.S. patents: U.S. Pat. No. 5,331,884 issued to Ando on Jul. 26, 1994; U.S. Pat. No. 6,553,766 issued to Shimizu et al. on Apr. 29, 2003; U.S. Pat. No. 6,585,095 issued to Savoyard et al. on Jul. 1, 2003; U.S. Pat. No. 6,609,884 issued to Harvey on Aug. 26, 2003; U.S. Pat. No. 6,638,123 issued to Kinomoto on Oct. 28, 2003; and U.S. Pat. No. 6,698,496 issued to Takayama et al. on Mar. 2, 2004.

Some examples of heater arrangements that may possibly be utilized or possibly adapted for use in at least one possible embodiment of the present application may possibly be found in the following U.S. patents: U.S. Pat. No. 6,404,421 issued to Meijler et al. on Jun. 11, 2002; U.S. Pat. No. 6,515,264 issued to Toya et al. on Feb. 4, 2003; U.S. Pat. No. 6,548,786 issued to Takizawa et al. on Apr. 15, 2003; U.S. Pat. No. 6,555,796 issued to Cusack on Apr. 29, 2003; U.S. Pat. No. 6,633,727 issued to Henrie et al. on Oct. 14, 2003; and U.S. Pat. No. 6,677,557 issued to Ito et al. on Jan. 13, 2004.

Some examples of starwheels which may possibly be utilized or adapted for use in at least one possible embodiment may possibly be found in the following U.S. patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

Some examples of temperature sensors or sensor systems that may be used or adapted for use in at least one possible embodiment of the present invention may be found in the following U.S. patents: U.S. Pat. No. 5,960,857, issued to inventors Oswalt et al. on Oct. 5, 1999; U.S. Pat. No. 5,942,980, issued to inventors Hoben et al. on Aug. 24, 1999; U.S. Pat. No. 5,881,952, issued to inventor MacIntyre on Mar. 16, 1999; U.S. Pat. No. 5,862,669, issued to inventors Davis et al. on Jan. 26, 1999; U.S. Pat. No. 5,459,890, issued to inventor Jarocki on Oct. 24, 1995; U.S. Pat. No. 5,367,602, issued to inventor Stewart on Nov. 22, 1994; U.S. Pat. No. 5,319,973, issued to inventors Crayton et al. on Jun. 14, 1994; U.S. Pat. No. 5,226,320, issued to inventors Dages et al. on Jul. 13, 1993; U.S. Pat. No. 5,078,123, issued to inventors Nagashima et al. on Jan. 7, 1992; and U.S. Pat. No. 5,068,030, issued to inventor Chen on Nov. 26, 1991.

Some examples of position sensors or position sensor systems that may be used or adapted for use in at least one possible embodiment of the present invention may be found in the following U.S. patents: U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

The patents, patent applications, and patent publications listed above, beginning on page 39 in the paragraph with the statement:

> "All of the patents, patent applications or patent publications, which were cited in the International Search Report dated Jan. 29, 2008, and/or cited elsewhere are hereby incorporated by reference as if set forth in their entirety herein as follows: U.S. Pat. No. 5,720,148 issued to Olivier BEDIN, ET AL on Feb. 24, 1998; DE 3434023 issued to SEITZ ENZINGER NOLL MASCH on Mar. 27, 1986; GB 06970 A. A.D. 1904 (GB 190406970) issued to Frank Eugene KEYES on Sep. 1, 1904; and DE 102 45 318 issued to Bernd HANSEN on Apr. 8, 2004,"

and ending on page 50 in the paragraph with the statement:

"Some examples of position sensors or position sensor systems that may be used or adapted for use in at least one possible embodiment of the present invention may be found in the following U.S. patents: U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978,"

are herein incorporated by reference as if set forth in their entirety. The purpose of incorporating these U.S. patents, Foreign patents, publications, etc., is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The containers are manufactured by delivering the blow-molded and finished containers to a filling machine where they are filled with the liquid to be bottled, and after the filling are closed with a suitable closure or keg fitting which, when used, allows the dispensing of the liquid to be bottled via a dispensing or tap valve. Examples of possible keg fittings are a basket keg fitting or a flat keg fitting manufactured by KHS Till GmbH, located at Kapellenstrasse 47-49, 65830 Kriftel, Federal Republic of Germany.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

| | AT LEAST PARTIAL NOMENCLATURE |
|---|---|
| 1 | Container |
| 2 | Container neck |
| 2.1 | Container mouth |
| 2.2, 2.3, 2.4 | Flange on the container neck |

-continued

| | AT LEAST PARTIAL NOMENCLATURE |
|---|---|
| 3 | Fitting |
| 3.1 | Fitting lip |
| 3.3 | Fitting protrusion |
| 4 | Valve insert |
| 5 | Gasket |
| 6 | Plant |
| 7 | Blow molding machine |
| 8 | Rotor |
| 9 | Blow mold |
| 10 | Preform |
| 11 | Supply or feed unit |
| 12 | Conveyor line |
| 13 | Conveyor line |
| 14 | Container carrier |
| 15 | Station for assembly of the containers 1 and fittings 3 |
| 16 | Centering or delivery element |
| 17 | Supply unit |
| 18 | Station for the substantially sufficiently tight connection of fitting and container |
| 19 | Pressing tool |
| 20 | Station for filling the containers |
| 21 | Filling element |
| 22 | Conveyor line |

What is claimed is:

1. A method of making and filling disposable, one-way, single-use home bar or portable bar kegs with a beverage such as mineral water, table water, beer, or a similar beverage, said disposable, one-way, single-use keg comprising: a disposable, one-way, single-use keg body; and a disposable, one-way, single-use fitting; said disposable, one-way, single-use keg body comprising: a body portion having a longitudinal dimension; a mouth opening; and a neck area comprising: a neck; a first keg flange and a second keg flange disposed on said neck, with said first keg flange being disposed on said neck further from said body portion than said second keg flange, and with said first keg flange comprising a diameter extending outwardly from said neck a sufficiently large distance to permit said first keg flange to be sufficiently bendable to allow said disposable, one-way, single-use fitting to slide over said first keg flange, and further comprising a longitudinal thickness being sufficiently small to permit said first keg flange to be sufficiently bendable to allow said disposable, one-way, single-use fitting to slide over said first keg flange yet sufficiently large to permit said first keg flange to sufficiently hold said disposable, one-way, single-use fitting sufficiently and sufficiently seal said disposable, one-way, single-use fitting on said disposable, one-way, single-use keg body, and with said second keg flange being configured to be held during placing said disposable, one-way, single-use fitting over said mouth opening and during filling said disposable, one-way, single-use keg with said beverage; said disposable, one-way, single-use fitting: being configured to permit filling of said disposable, one-way, single-use keg with a beverage and dispensing of said beverage from said disposable, one-way, single-use keg to a home bar or portable bar, and further being configured to fit with a bar fitting to permit flow of a beverage to a tap of a home bar or portable bar; said disposable, one-way, single-use fitting comprising a ring-shaped portion; said ring-shaped portion consisting of a single plastic piece and being configured to be disposed to surround said mouth opening and a portion of said neck area of said disposable, one-way, single-use keg body upon installation of said disposable, one-way, single-use fitting on said disposable, one-way, single-use keg body; said ring-shaped portion comprising an outer surface and a fitting lip being disposed to project radially inwardly away from said outer surface; said outer surface being configured to be disposed, upon installation of said disposable, one-way, single-use fitting on said disposable, one-way, single-use keg body, radially further from a central longitudinal axis of said disposable, one-way, single-use fitting, along a radius extending perpendicularly from said central longitudinal axis and through said first keg flange, than any other portion of said disposable, one-way, single-use fitting along said radius; said fitting lip comprising an inner diameter extending inwardly a sufficiently large distance to permit said fitting lip to be sufficiently bendable to allow passage of said fitting lip over said first keg flange and further comprising a longitudinal thickness being sufficiently small to permit said fitting lip to be sufficiently bendable to allow said disposable, one-way, single-use fitting to slide over said first keg flange yet sufficiently large to permit solely said first keg flange and said fitting lip to sufficiently hold said disposable, one-way, single-use fitting sufficiently and sufficiently seal said disposable, one-way, single-use fitting on said disposable, one-way, single-use keg; said fitting lip being configured to slide over said first keg flange during assembly; said fitting lip comprising a flat retaining surface and said first keg flange comprising a flat retaining surface; said flat retaining surfaces each being disposed to extend substantially radially with respect to a central longitudinal axis, and being configured to engage one another upon installation of said disposable, one-way, single-use fitting on said disposable, one-way, single-use keg to retain said disposable, one-way, single-use fitting on said disposable, one-way, single-use keg body; said disposable, one-way, single-use fitting comprising a gasket configured to form a sufficiently tight connection between said disposable, one-way, single-use fitting and said disposable, one-way, single-use keg body to contain said beverage in said disposable, one-way, single-use keg;

said method comprising the steps of:

heating a keg preform, said keg preform being configured to be blow-molded to a disposable, one-way, single-use keg body having a volume of about ten liters to about twenty liters, to a temperature to permit blow-molding of said keg preform to a disposable, one-way, single-use keg body having a volume of about ten liters to about twenty liters;

blow-molding said keg preform to form a disposable, one-way, single-use keg body having a volume of about ten liters to about twenty liters, thus forming said disposable, one-way, single-use keg body comprising:

a body portion having a longitudinal dimension;

a mouth opening; and a neck area comprising:

a neck;

a first keg flange and a second keg flange disposed on said neck, with said first keg flange being disposed on said neck further from said body portion than said second keg flange, and with said first keg flange comprising a diameter extending outwardly from said neck a sufficiently large distance to permit said first keg flange to be sufficiently bendable to allow said disposable, one-way, single-use fitting to slide over said first keg flange, and further comprising a longitudinal thickness being sufficiently small to permit said first keg flange to be sufficiently bendable to allow said disposable, one-way, single-use fitting to slide over said first keg flange yet sufficiently large to permit said first keg flange to sufficiently hold said disposable, one-way, single-use fitting sufficiently and sufficiently seal said disposable, one-way, single-use fitting on said disposable, one-way, single-use keg body, and with said second keg flange being configured to be held during placing said disposable, one-way, single-use fitting over said mouth opening and during filling said disposable, one-way, single-use keg with said beverage;

holding said disposable, one-way, single-use keg by said second keg flange with holding apparatus and placing said disposable, one-way, single-use fitting over said mouth opening and installing said disposable, one-way, single-use fitting on said disposable, one-way, single-use keg body;

installing said disposable, one-way, single-use fitting on said disposable, one-way, single-use keg body, said step of installing comprising:

holding said disposable, one-way, single-use keg body by said second keg flange with holding apparatus;

sliding said fitting lip of said disposable, one-way, single-use fitting over said first keg flange while substantially simultaneously bending at least one of said fitting lip and said first keg flange to allow passage of said fitting lip over said first keg flange; and as a final step of installing, continuing sliding said fitting lip until said fitting lip is moved axially past said first keg flange and then radially inwardly to a position in which said flat retaining surfaces of said fitting lip and said first keg flange engage one another, and thus holding said disposable, one-way, single-use fitting on said disposable, one-way, single-use keg body with solely said first keg flange and said fitting lip, and thus sealing said disposable, one-way, single-use fitting on said disposable, one-way, single-use keg body, and thus forming a tight connection between said disposable, one-way, single-use fitting and said disposable, one-way, single-use keg body with said gasket sufficient to contain said beverage in said disposable, one-way, single-use keg; and holding said disposable, one-way, single-use keg by said second keg flange with holding apparatus in a filling station, connecting a filling element configured to connect with said disposable, one-way, single-use fitting to said disposable, one-way, single-use fitting, filling said disposable, one-way, single-use keg with said beverage, such as mineral water, table water, beer, or a similar beverage, and retaining said disposable, one-way, single-use fitting on said filled, disposable, one-way, single-use keg with solely said first keg flange and said fitting lip.

2. The method according to claim 1, wherein:

the steps of heating a keg preform, blow-molding said keg preform, placing said disposable, one-way, single-use fitting over said mouth opening of said disposable, one-way, single-use keg body, sliding said fitting lip of said disposable, one-way, single-use fitting over said first keg flange and bending said fitting lip and said first keg flange, forming a tight connection between said disposable, one-way, single-use fitting and said disposable, one-way, single-use keg body, and filling said disposable, one-way, single-use keg with said beverage are performed in chronological sequence essentially immediately after one another in a beverage filling plant;

said beverage filling plant includes a filling machine, and said filling of said disposable, one-way, single-use keg with said beverage comprises filling said disposable, one-way, single-use keg in said filling machine; and the steps of forming a tight connection between said disposable, one-way, single-use fitting and said disposable, one-way, single-use keg body, placing said disposable, one-way, single-use fitting over said mouth opening of said disposable, one-way, single-use keg body, and sliding said fitting lip of said disposable, one-way, single-use fitting over said first keg flange and bending said fitting lip and said first keg flange, comprise tightening said disposable, one-way, single-use fitting on said disposable, one-way, single-use keg body in said filling machine, placing said disposable, one-way, single-use fitting over said mouth opening of said disposable, one-way, single-use keg body, and sliding said fitting lip of said disposable, one-way, single-use fitting over said first keg flange and bending said fitting lip and said first keg flange in said filling machine.

3. The method according to claim 1, wherein:

the steps of heating a keg preform, blow-molding said keg preform, placing said disposable, one-way, single-use fitting over said mouth opening of said disposable, one-way, single-use keg body, sliding said fitting lip of said disposable, one-way, single-use fitting over said first keg flange and bending said fitting lip and said first keg flange, forming a tight connection between said disposable, one-way, single-use fitting and said disposable, one-way, single-use keg body, and filling said disposable, one-way, single-use keg with said beverage are performed in chronological sequence essentially immediately after one another in a beverage filling plant;

said beverage filling plant includes a filling machine, and said filling of said disposable, one-way, single-use keg with said beverage comprises filling said disposable, one-way, single-use keg in said filling machine; and the steps of forming a tight connection between said disposable, one-way, single-use fitting and said disposable, one-way, single-use keg body, placing said disposable, one-way, single-use fitting over said mouth opening of said disposable, one-way, single-use keg body, and sliding said fitting lip of said disposable, one-way, single-use fitting over said first keg flange and bending said fitting lip and said first keg flange, comprise tightening said disposable, one-way, single-use fitting on said disposable, one-way, single-use keg body in said filling machine, placing said disposable, one-way, single-use fitting over said mouth opening of said disposable, one-way, single-use keg body, and sliding said fitting lip of said disposable, one-way, single-use fitting over said first keg flange and bending said fitting lip and said first keg flange in separate stations.

4. A method of making and filling disposable, one-way, single-use home bar or portable bar kegs with a beverage; said disposable, one-way, single-use home bar or portable bar keg comprising: a disposable, one-way, single-use keg body; and a disposable, one-way, single-use fitting; said disposable, one-way, single-use keg body comprising: a body; a mouth opening; and a neck area comprising: a neck; a keg body protrusion structure being disposed on said neck; said keg body protrusion structure comprising a diameter extending outwardly from said neck a sufficiently large distance to hold said disposable, one-way, single-use fitting sufficiently and sufficiently seal said disposable, one-way, single-use fitting on said disposable, one-way, single-use keg body; said disposable, one-way, single-use fitting: being configured to permit filling of said disposable, one-way, single-use keg with a beverage and dispensing said beverage from said disposable, one-way, single-use keg to a home bar or portable bar, and further being configured to fit with a home bar or portable bar fitting to permit flow of a beverage to a tap of a home bar or portable bar; said disposable, one-way, single-use fitting comprising a ring-shaped portion; said ring-shaped portion being configured to be disposed to surround said mouth opening and a portion of said neck area of said disposable, one-way, single-use keg body upon installation of said disposable, one-way, single-use fitting on said disposable, one-way, single-use keg body; said ring-shaped portion comprising an outer surface and a fitting protrusion structure being disposed to project radially inwardly away from said outer surface; said outer surface being configured to be disposed, upon installation of said disposable, one-way, single-use fitting on said disposable, one-way, single-use keg body, radially further from a central longitudinal axis of said disposable, one-way, single-use fitting, along a radius extending perpendicularly from said central longitudinal axis and through said keg body protrusion structure, than any other portion of said disposable, one-way, single-use fitting along said radius; said fitting protrusion structure comprising an inner diameter extending inwardly a sufficiently large distance to sufficiently hold said disposable, one-way, single-use fitting sufficiently and sufficiently seal said disposable, one-way, single-use fitting on said disposable, one-way, single-use keg body; said disposable, one-way, single-use fitting comprising a seal configured to form a sufficiently tight connection between said disposable, one-way, single-use fitting and said disposable, one-way, single-use keg body to contain said beverage in said disposable, one-way, single-use keg;

said method comprising the steps of:

heating a keg preform, said keg preform being configured to be capable of being blow-molded to a disposable, one-way, single-use keg body having a volume configured for disposable, one-way, single-use home bar or portable bar kegs, to a temperature to permit blow-molding of said keg preform to a disposable, one-way, single-use keg body having a volume configured for disposable, one-way, single-use home bar or portable bar kegs;

blow-molding said keg preform to form a disposable, one-way, single-use keg body having a volume configured for disposable, one-way, single-use home bar or portable bar kegs, thus forming said disposable, one-way, single-use keg body comprising:

a body;

a mouth opening; and a neck area comprising:

a neck;

a keg body protrusion structure being disposed on said neck which keg body protrusion structure comprises a diameter extending outwardly from said neck a sufficiently large distance to hold said disposable, one-way, single-use fitting sufficiently and sufficiently seal said disposable, one-way, single-use fitting on said disposable, one-way, single-use keg body;

placing said disposable, one-way, single-use fitting over said mouth opening of said disposable, one-way, single-use keg body and as installing said disposable, one-way, single-use fitting on said disposable, one-way, single-use keg body;

forming a tight connection between said disposable, one-way, single-use fitting and said disposable, one-way, single-use keg body with said seal to sufficiently contain said beverage in said disposable, one-way, single-use keg; and filling said disposable, one-way, single-use keg with said beverage.

5. The method according to claim 4, wherein:

said fitting protrusion structure comprises a flat retaining surface and said keg body protrusion structure comprises a flat retaining surface;

said flat retaining surfaces each are disposed to extend substantially radially with respect to said central longitudinal axis, and are configured to engage one another upon installation of said disposable, one-way, single-use fitting on said disposable, one-way, single-use keg to retain said disposable, one-way, single-use fitting on said disposable, one-way, single-use keg body; and said step of installing comprises:

moving said fitting protrusion structure of said disposable, one-way, single-use fitting over said keg body protrusion structure; and as a final step of installing, continuing moving said fitting protrusion structure until said fitting protrusion structure is moved axially past said keg body protrusion structure and then radially inwardly to a position in which said flat retaining surfaces of said fitting protrusion structure and said keg body protrusion structure engage one another; and the steps of heating a keg preform, blow-molding said keg preform, placing said disposable, one-way, single-use fitting over said mouth opening of said disposable, one-way, single-use keg body, installing said disposable, one-way, single-use fitting on said disposable, one-way, single-use keg body, forming a tight connection between said disposable, one-way, single-use fitting and said disposable, one-way, single-use keg body, and filling said disposable, one-way, single-use keg with said beverage are performed in chronological sequence essentially immediately after one another in a beverage filling plant.

6. The method according to claim 5 wherein said beverage filling plant includes a filling machine, and wherein said filling of said disposable, one-way, single-use keg with said beverage comprises filling said disposable, one-way, single-use keg in said filling machine.

7. The method according to claim 6, wherein the step of forming a tight connection between said disposable, one-way, single-use fitting and said disposable, one-way, single-use keg body comprises tightening said disposable, one-way, single-use fitting on said disposable, one-way, single-use keg body in said filling machine.

8. The method according to claim 7, wherein the steps of placing said disposable, one-way, single-use fitting over said mouth opening of said disposable, one-way, single-use keg body and installing said disposable, one-way, single-use fitting on said disposable, one-way, single-use keg body comprises placing said disposable, one-way, single-use fitting over said mouth opening of said disposable, one-way, single-use keg body and installing said disposable, one-way, single-use fitting on said disposable, one-way, single-use keg body in said filling machine.

9. The method according to claim 4, wherein the step of installing said disposable, one-way, single-use fitting on said disposable, one-way, single-use keg body further comprises screwing said disposable, one-way, single-use fitting onto said keg body protrusion structure of said disposable, one-way, single-use keg body.

10. The method according to claim 8, wherein:

said keg body protrusion structure comprises a keg flange;

said fitting protrusion structure comprises a fitting protrusion; and the step of installing said disposable, one-way, single-use fitting on said disposable, one-way, single-use keg body further comprises sliding said fitting protrusion of said disposable, one-way, single-use fitting over said keg flange and bending said fitting protrusion and said keg flange to allow passage of said fitting protrusion over said keg flange.

11. The method according to claim 4, wherein the steps of forming a tight connection between said disposable, one-way, single-use fitting and said disposable, one-way, single-use keg body, placing said disposable, one-way, single-use fitting over said mouth opening of said disposable, one-way, single-use keg body, and installing said disposable, one-way, single-use fitting on said disposable, one-way, single-use keg body comprises forming a tight connection between said disposable, one-way, single-use fitting and said disposable, one-way, single-use keg body, placing said disposable, one-way, single-use fitting over said mouth opening of said disposable, one-way, single-use keg body, and installing said disposable, one-way, single-use fitting on said disposable, one-way, single-use keg body in separate stations.

12. The method according to claim 11, wherein the step of installing said disposable, one-way, single-use fitting on said disposable, one-way, single-use keg body further comprises screwing said disposable, one-way, single-use fitting onto said keg body protrusion structure of said disposable, one-way, single-use keg body.

13. The method according to claim 11, wherein:

said fitting protrusion structure comprises a flat retaining surface and said keg body protrusion structure comprises a flat retaining surface; said flat retaining surfaces each are disposed to extend substantially radially with respect to said central longitudinal axis, and are configured to engage one another upon installation of said disposable, one-way, single-use fitting on said disposable, one-way, single-use keg to retain said disposable, one-way, single-use fitting on said disposable, one-way, single-use keg body; and said step of installing comprises:

moving said fitting protrusion structure of said disposable, one-way, single-use fitting over said keg body protrusion structure; and as a final step of installing, continuing moving said fitting protrusion structure until said fitting protrusion structure is moved axially past said keg body protrusion structure and then radially inwardly to a position in which said flat retaining surfaces of said fitting protrusion structure and said keg body protrusion structure engage one another;

said keg body protrusion structure comprises a keg flange;

said fitting protrusion structure comprises a fitting protrusion; and the step of installing said disposable, one-way, single-use fitting on said disposable, one-way, single-use keg body further comprises sliding said fitting protrusion of said disposable, one-way, single-use fitting over said keg flange and bending said fitting protrusion and said keg flange to allow passage of said fitting protrusion over said keg flange.

14. A keg-making and keg-filling apparatus configured to make and fill disposable, one-way, single-use home bar or portable bar kegs with a beverage, said keg-making and keg-filling device comprising:

a preheating station being configured to preheat a keg preform, said keg preform being configured to be capable of being blow-molded to a disposable, one-way, single-use keg body having a volume configured for disposable, one-way, single-use home bar or portable bar kegs, to a temperature to permit blow-molding of said keg preform to a disposable, one-way, single-use keg body having a volume configured for disposable, one-way, single-use home bar or portable bar kegs;

a blow-molding station being configured to blow-mold said keg preform to form a disposable, one-way, single-use keg body having a volume configured for disposable, one-way, single-use home bar or portable bar kegs, thus forming said disposable, one-way, single-use keg body being configured to be assembled with a disposable, one-way, single-use fitting being configured to permit filling of said disposable, one-way, single-use keg with a beverage and dispensing said beverage from said disposable, one-way, single-use keg to a home bar or portable bar, and further being configured to fit with a home bar or portable bar fitting to permit flow of a beverage to a tap of a home bar or portable bar;

said blow molding station being configured to form said disposable, one-way, single-use keg body which disposable, one-way, single-use keg body comprises:

a body;

a mouth opening; and a neck area comprising:

a neck;

a first keg body protrusion flange structure, configured to hold said disposable, one-way, single-use fitting, being disposed on said neck;

a second keg body protrusion flange structure, configured to be held during placing said disposable, one-way, single-use fitting over said mouth opening and during filling said disposable, one-way, single-use keg with said beverage, being disposed on said neck closer to said body than said first keg body protrusion flange structure;

said disposable, one-way, single-use fitting comprising a ring-shaped portion;

said ring-shaped portion being configured to be disposed to surround said mouth opening and a portion of said neck area of said disposable, one-way, single-use keg body upon installation of said disposable, one-way, single-use fitting on said disposable, one-way, single-use keg body;

said ring-shaped portion comprising an outer surface and a fitting protrusion structure being disposed to project radially inwardly away from said outer surface;

said outer surface being configured to be disposed, upon installation of said disposable, one-way, single-use fitting on said disposable, one-way, single-use keg body, radially further from a central longitudinal axis of said disposable, one-way, single-use fitting, along a radius extending perpendicularly from said central longitudinal axis and through said first keg body protrusion flange structure, than any other portion of said disposable, one-way, single-use fitting along said radius;

said fitting protrusion structure comprising an inner diameter extending inwardly a sufficiently large distance to sufficiently hold said disposable, one-way, single-use fitting sufficiently and sufficiently seal said disposable, one-way, single-use fitting on said disposable, one-way, single-use keg body;

said fitting protrusion structure being configured to allow said disposable, one-way, single-use fitting to pass over said first keg body protrusion flange structure;

said disposable, one-way, single-use fitting comprising a seal configured to form a sufficiently tight connection between said disposable, one-way, single-use fitting and said disposable, one-way, single-use keg body to contain said beverage in said disposable, one-way, single-use keg;

said first keg body protrusion flange structure comprising a diameter extending outwardly from said neck a sufficiently large distance to hold said disposable, one-way, single-use fitting sufficiently and sufficiently seal said disposable, one-way, single-use fitting on said disposable, one-way, single-use keg body;

carrier apparatus being configured to hold said keg body by said second keg body protrusion flange structure during installing and during filling;

placing apparatus being configured to place said disposable, one-way, single-use fitting over said mouth opening of said disposable, one-way, single-use keg body and to assemble said disposable, one-way, single-use fitting to said first keg body protrusion flange structure;

sealing apparatus being configured to form a tight connection between said disposable, one-way, single-use fitting and said disposable, one-way, single-use keg body with said seal to sufficiently contain said beverage in said disposable, one-way, single-use keg;

said sealing apparatus comprising at least one sealing tool;

a filling station being configured to fill said disposable, one-way, single-use keg with said beverage; and said filling station comprising a filling element configured to connect with a disposable, one-way, single-use fitting.

15. The keg-making and keg-filling apparatus according to claim 14, wherein:

said fitting protrusion structure comprises a flat retaining surface and said first keg body protrusion flange structure comprises a flat retaining surface;

said flat retaining surfaces each are disposed to extend substantially radially with respect to said central longitudinal axis, and are configured to engage one another upon installation of said disposable, one-way, single-use fitting on said disposable, one-way, single-use keg to retain said disposable, one-way, single-use fitting on said disposable, one-way, single-use keg body;

said at least one sealing tool comprises a pressing tool; and said pressing tool being configured to press on said disposable, one-way, single-use fitting and seal said disposable, one-way, single-use fitting on said disposable, one-way, single-use keg body to form said disposable, one-way, single-use keg such that at least one of said fitting protrusion structure and said first keg body protrusion flange structure is bent to allow passage of said fitting protrusion structure over said first keg body protrusion flange structure to sufficiently hold said disposable, one-way, single-use fitting and sufficiently seal said disposable, one-way, single-use fitting on said disposable, one-way, single-use keg body.

16. The keg-making and keg-filling apparatus according to claim 14, wherein said at least one tool comprises a screwing tool;

said screwing tool being configured to screw on said disposable, one-way, single-use fitting and seal said disposable, one-way, single-use fitting on said disposable, one-way, single-use keg body to form said disposable, one-way, single-use keg.

17. The keg-making and keg-filling apparatus according to claim 14 including a fitting station and an installing station, wherein:

said fitting station comprises said placing apparatus; and said installing station comprises said sealing apparatus.

18. The keg-making and keg-filling apparatus according to claim 14 including an installing station, wherein said installing station comprises said placing apparatus and said sealing apparatus.

19. The keg-making and keg-filling apparatus according to claim 14, wherein said filling station comprises a linear design.

20. The keg-making and keg-filling apparatus according to claim 14, wherein said filling station comprises a rotary design.

* * * * *